US012024955B2

(12) United States Patent
Mahendran et al.

(10) Patent No.: US 12,024,955 B2
(45) Date of Patent: Jul. 2, 2024

(54) CONTACT CHAMBER FLUSHING APPARATUS FOR CONCENTRIC ELECTRICAL WET CONNECT

(71) Applicant: Halliburton Energy Services, Inc., Houston, TX (US)

(72) Inventors: Mathusan Mahendran, Singapore (SG); Bryan Thomas Philpott, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 32 days.

(21) Appl. No.: 17/967,545

(22) Filed: Oct. 17, 2022

(65) Prior Publication Data

US 2024/0125183 A1 Apr. 18, 2024

(51) Int. Cl.
*E21B 17/02* (2006.01)
*E21B 34/06* (2006.01)
*E21B 34/08* (2006.01)

(52) U.S. Cl.
CPC ..... *E21B 17/028* (2013.01); *E21B 34/066* (2013.01); *E21B 34/085* (2013.01)

(58) Field of Classification Search
CPC ..... E21B 17/028; E21B 34/066; E21B 34/085
See application file for complete search history.

(56) References Cited

U.S. PATENT DOCUMENTS 4,537,457 A 8/1985 Davis, Jr. et al.
5,577,925 A * 11/1996 Schnatzmeyer ..... E21B 34/10 439/191
6,776,636 B1 * 8/2004 Cameron ..... H01R 13/523 439/191
7,640,977 B2 * 1/2010 Jonas ..... E21B 17/08 166/242.6
7,644,755 B2 1/2010 Stoesz et al.
7,900,698 B2 3/2011 Stoesz
8,122,967 B2 2/2012 Richards
8,752,635 B2 6/2014 Wang et al.
9,753,230 B2 * 9/2017 Burrow ..... G02B 6/3816
(Continued)

FOREIGN PATENT DOCUMENTS

EP 2520757 A2 11/2012

OTHER PUBLICATIONS

Foreign Communication from Related Application—International Search Report and Written Opinion of the International Searching Authority, International Application No. PCT/US2022/047527, dated Jul. 4, 2023, 12 pages.

*Primary Examiner* — Nicole Coy
(74) *Attorney, Agent, or Firm* — Conley Rose, P.C.; Rodney B. Carroll

(57) ABSTRACT

A downhole tool for coupling an electrical connection in the wellbore comprising a locator sub and a receptacle sub. The locator sub can be conveyed into the wellbore with a workstring. The receptacle sub can be coupled to a lower completion with at least one downhole tool. Workstring manipulation can insert the locator sub into the receptacle sub to provide an electrical connection between a resilient connector on the locator sub and ring connector within the receptacle sub. A fluid source fluidically connected to the electrical connection can flush out trapped wellbore fluids via a fluid pathway. The electrical connection can electrically couple to a control system at surface to the at least one downhole tool.

21 Claims, 7 Drawing Sheets

(56) References Cited

U.S. PATENT DOCUMENTS

| | | | | |
|---|---|---|---|---|
| 9,843,129 | B2 * | 12/2017 | Burrow | H01R 13/5227 |
| 11,193,339 | B2 | 12/2021 | El Mallawany | |
| 2003/0211768 | A1 | 11/2003 | Cameron et al. | |
| 2004/0159444 | A1 | 8/2004 | Wolters et al. | |
| 2016/0233608 | A1 | 8/2016 | Burrow et al. | |
| 2021/0010333 | A1 * | 1/2021 | El Mallawany | E21B 17/028 |

* cited by examiner

CONTACT CHAMBER FLUSHING APPARATUS FOR CONCENTRIC ELECTRICAL WET CONNECT

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

A production string typically comprises tubing that is run into the casing of an oil and gas well and is used to transfer wellbore fluids to and from the surface. Additionally, the production string may have conduits for supplying power, communication, or treatment fluids to downhole tools. The conduits may deliver control fluids for communication to direct downhole tools, hydraulic power to actuate downhole tools, or injection fluids to downhole formations via downhole tools. Further, the production string may have conduits containing conductors (e.g., wires) that communicate electrical signals to and from downhole instrumentation and devices. These conduits can be external to the production string or downhole tools with some portions transitioning to an internal pathway. At other points, the conduits may pass downward through the downhole tools or be connected by fittings to ports, channels or small diameter bores within the well tubulars or tools.

During the lifecycle of the production well, it can be desirable or necessary to break a connection in a production string in order to permit a portion of the production string to be withdrawn from the wellbore while another portion of the string remains installed below the surface. For example, it may be necessary to break a connection in a production string during a workover operation and reconnect the production string after a wellbore servicing operation.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
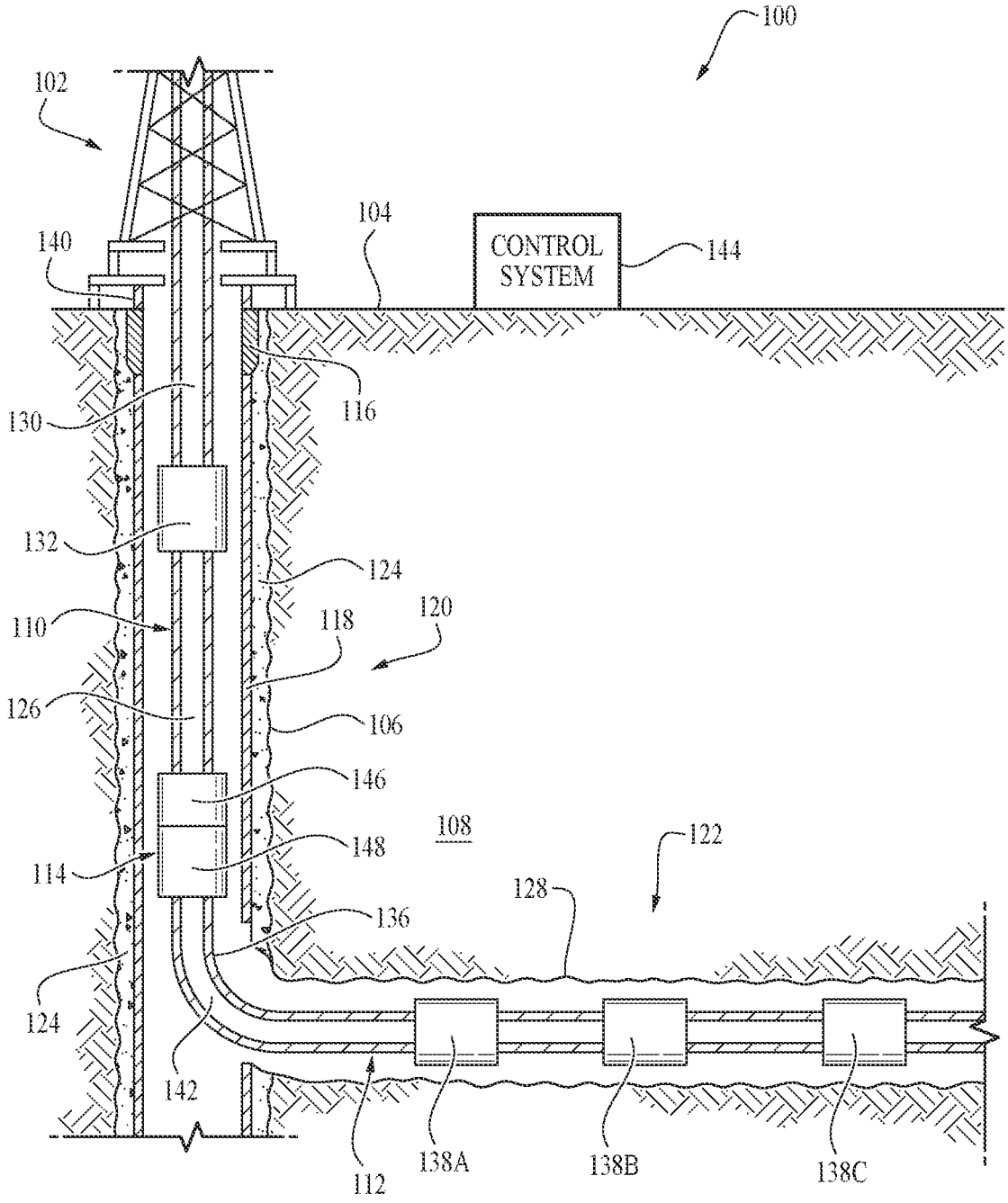
FIG. 1 is a schematic view of a wellbore environment showing an embodiment of the electrical wet connect assembly.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

An electrical wet connect tool, also referred to as a disconnect tool, can be part of a production string configured to produce fluids from or inject fluids into a subterranean formation. The production string generally comprises a tubular string extending from the surface to a target location, e.g., a production zone, in a wellbore. The electrical wet connect tool. e.g., disconnect tool, can include a disconnect mandrel, a disconnect receptacle, and at least one electrical connection. The disconnect mandrel can be a generally cylindrical shape with a concentric resilient electrical contact, e.g. a male connector. The disconnect receptacle can be a generally cylindrical shape with a concentric ring connector, e.g., a female connector. The disconnect mandrel can be inserted into the disconnect receptacle such that the disconnect mandrel is concentric with the disconnect receptacle and mate the concentric electrical connection, for example, connect the male connector with the female connector. A wellbore servicing operation may require the disconnect mandrel and the disconnect receptacle to be connected, i.e. mated, and disconnected multiple times, for example, when replacing equipment such as the safety valve or electrical submersible pumps in the upper completion. Wellbore fluids can be trapped within the concentric electrical connection each time the disconnect mandrel is inserted into the disconnect receptacle. These trapped wellbore fluids can reduce the insulation resistance between the electrical contacts and the wellbore environment, promote corrosion, and prevent a reliable transfer of high voltage power to downhole tools located below the disconnect receptacle. A method of improving and preserving the insulation resistance of the electrical connection is desirable.

One solution for improving the insulation resistance of the electrical contacts can include the removal of wellbore fluid from the electrical contacts. In some embodiments, the concentric electrical contacts can form a chamber with connector seals when the disconnect mandrel is inserted into the receptacle. A small volume of wellbore fluids can be trapped within the chamber between the seals. The concentric electrical contacts can include at least one port for the trapped volume of wellbore fluids to exit. In some embodiments, a fluid flow path can be formed from a volume of flushing fluid to the concentric electrical contacts, through the chamber formed by the seals, and out the exit port. The wellbore fluids can be flushed out the concentric electrical connection with a flushing fluid via the fluid flow path. In some embodiments, the flushing fluid can insulate the electrical connection and provide corrosion protection by replacing the potentially conductive and corrosive fluids. In some embodiments, the volume of flushing fluid passed through the fluid flow path can remove particles and debris from the trapped volume.

Another solution for improving the insulation resistance of the electrical contacts can include the ability to disconnect and reconnect multiple times. In some scenarios, the wellbore servicing operations can include disconnecting and reconnecting the electrical connection, for example, to replace equipment in the upper completion, such as the safety valve. In some embodiments, the disconnect mandrel can have more than one volume of flushing fluid to circulate through the fluid flow path. Wellbore fluids can be flushed out of the electrical connection more than one time to allow for multiple connections. In some embodiments, the disconnect tool can include at least one electrical connection and at least one hydraulic connection. The disconnect tool can include multiple electrical connections and multiple hydraulic connections to pass communication, power, and control from one or more tools above the disconnect tool to one or more tools below the disconnect tool. The insertion of the disconnect mandrel into the disconnect receptacle can couple the multiple electrical connections and multiple hydraulic connections. In some embodiments, the disconnect mandrel can be coupled to an upper portion of a production string and the disconnect receptacle can be coupled to a lower portion of the production string. In some embodiments, the disconnect receptacle can be coupled to the upper portion of a production string and the disconnect mandrel can be coupled to the lower portion of the production string.

In an embodiment, the disconnect tool for connecting at least one electrical connection can include a scalable concentric resilient electrical connector, an exit port within the concentric resilient electrical connector, a volume of flushing fluid, and a fluid flow path. The fluid flow path can include the volume of flushing fluid, a pathway through the disconnect mandrel, at least one port into the concentric resilient electrical connector, and a second pathway through the disconnect mandrel or the disconnect receptacle. In addition, a trigger device can be coupled to the volume of flushing fluid to discharge a volume of flushing fluid into the fluid flow path in response to a triggering event.

Turning now to FIG. 1, an illustration of a wellbore environment 100 that may employ one or more embodiments of the electrical wet connect tool described herein. In an embodiment, a wellbore servicing operation can comprise an upper completion 110, a lower completion 112, and an electrical wet connect tool, also called an electrical disconnect tool 114, within a wellbore 106. The wellbore 106 can include one or more casing strings 118, e.g., a set of tubular pieces threadedly coupled together, that are anchored at the surface 104 with a wellhead 116. The wellbore 106 can comprise a vertical portion 120 and a horizontal portion 122. The vertical portion 120 can extend from the surface 104 to depth within a target subterranean formation. The wellbore 106 can transition from the vertical portion 120 to a substantively horizontal portion 122 or the horizontal portion 122 can be formed, e.g., drilled, from the vertical portion 120, typically referred to as a lateral wellbore 128. In some embodiments, portions or substantially all of the wellbore 106 may be vertical, deviated, horizontal, and/or curved. The casing string 118 can be secured and hydraulically isolated by a cement sheath 124 extending along all or a portion of the length of the casing string 118. The uncased portion of the lateral wellbore 128 can be referred to as an open-hole section. The upper completion 110 can comprise a workstring 130 coupled to the electrical disconnect tool 114. In some embodiments, the upper completion 110 can include one or more production tools 132, e.g., a safety valve. The lower completion 112 can comprise a lower completion tubular 136 and at least one downhole device 138. The lower completion tubular, also referred to as tubular 136, and the at least one downhole device 138 can extend from the electrical disconnect tool 114 to a target formation.

The wellbore environment 100 may include servicing rig 102 arranged at the Earth's surface 104 and coupled to the wellbore 106. The servicing rig 102 may comprise a drilling rig, a work-over rig, a service rig, a coil tubing rig, or similar wellbore servicing equipment that supports a workstring 130. It is understood that mechanical mechanisms known to those in the arts can control the run-in and withdrawal of the workstring 130 in the wellbore 106, for example, a draw works coupled to a hoisting apparatus, another servicing vehicle, a coiled tubing unit, and/or other lifting apparatus.

Although FIG. 1 depicts a land-based wellbore environment 100, it will be appreciated that the embodiments disclosed herein are equally well suited for use in any other type of rig including, but not limited to, floating or sea-based platforms and rigs, or rigs used in any other geographical location without departing from the scope of the disclosure. In some cases, such as in an off-shore location, the servicing rig 102. e.g., the drilling rig, can be supported by piers extending downwards to a seabed. e.g., the surface 104. Alternatively, the servicing rig 102 can be supported by columns sitting on hulls and/or pontoons that are ballasted below the water surface, which can be referred to as a semi-submersible platform or floating rig. In deep water applications, the servicing rig 102 can be supported by a drillship. In an off-shore location, a riser 140, also called a casing string, can extend from the servicing rig 102 to the ocean floor, e.g., surface 104, to exclude sea water and contain drilling fluid returns.

In some embodiments, the servicing rig 102 may be a workover rig and the wellhead 116 can include a pressure containment device. The servicing rig 102 and associated servicing equipment may be used to stimulate and otherwise prepare the wellbore 106 and surrounding subterranean formation 108 for the production of hydrocarbons therefrom. The wellhead 116 can comprise a production tree, a surface tree, a subsea tree, a lubricator connector, a blowout preventer, or combinations thereof and may be configured for the production of hydrocarbons from the wellbore 106.

The servicing rig 102 may support or otherwise help manipulate the axial position of a workstring 130 extending into the wellbore 106. In some embodiments, the workstring 130 may include, but not be limited to, one or more types of connected lengths of drill pipe, casing tubular, production tubing, landing string, liners, coiled tubing, or combinations thereof. The workstring 130 can be generally tubular in shape with an inner bore 126, e.g., a flow bore. As illustrated in FIG. 1, the wellbore 106 may extend substantially vertically away from surface 104 over a vertical wellbore portion 120. In other embodiments, the wellbore 106 may otherwise deviate at any angle from the surface 104 over a deviated or horizontal wellbore portion 122. The servicing rig 102 may manipulate the workstring 130 and one or more tools coupled to the workstring 130 through vertical, deviated, or horizontal portions of the wellbore 106.

The lower completion 112 may comprise one or more downhole devices 138 coupled to the tubular 136. The downhole device 138 can isolate the wellbore environment, provide flow control, measure wellbore properties, or combinations thereof. In some embodiments, the downhole device 138 can form a seal between an outer surface of the tubular 136 and an inner surface of the lateral wellbore 128. For example, the downhole device 138 may comprise a packer. In some embodiments, the downhole device 138 can control the flow of wellbore fluids into an inner passage 142 of the tubular 136 from the subterranean formation 108. For example, the downhole device 138 may comprise a production sleeve configured to open, meter or choke, and/or shut off the flow of fluids. In some embodiments, the downhole device 138 can provide periodic measurements of the wellbore environment with sensors. For example, the downhole device 138 can include sensors to measure pressure, temperature, fluid density, fluid flowrate, position, or combinations thereof. The lower completion 112 may comprise at least two downhole devices 138 spaced axially along the lower completion 112, for example, the downhole devices 138A, 138B, and 138C. In some embodiments, the downhole devices 138 may comprise sensors to measure the wellbore environment (e.g., pressure, temperature, density, flowrate), pumps, packers, gauges, valves, chokes, and other devices used to monitor and control operations performed in the wellbore. Although three downhole devices 138 are shown, it is understood that there may be 1, 2, 3, 4, 5, 6, 7, 8, 9, 10, or any number of downhole devices 138.

A control system 144 may control various aspects of the operations performed in the wellbore. The control system 144 can be a computer system configured to control various aspects of the operation of the wellbore environment 100. In some embodiments, the control system 144 can be electrically coupled to downhole devices 138 via conductor conduits and/or hydraulic conduits coupled to the outside of or routed within the tubulars 136. Two or more structures can pass signal communication, electrical power, or both when they are electrically coupled or electrically connected. Although the control system 144 is illustrated as located at the surface 104, it is understood that the control system 144 can be located on the rig 102, on the sea floor, within the wellbore 106, or combinations thereof.

The wellbore environment 100 includes an electric disconnect tool 114. In some embodiments, the electric disconnect tool 114 can be located between an upper completion 110 and a lower completion 112 of the wellbore completion. The electric disconnect tool 114 can comprise an upper portion 146 coupled to the upper completion 110 and a lower portion 148 coupled to the lower completion 112. The electric disconnect tool 114 can have a connected configuration wherein the upper portion 146 is coupled to the lower portion 148 allowing for the production of wellbore fluids, or injection of fluids to stimulate other wells, through an interior bore of the electrical disconnect tool 114 and electrical connections and hydraulic connections can be maintained through the electric disconnect tool 114. The connected configuration of the electric disconnect tool 114 can fluidically connect the inner passage 142 of the lower completion 112 to the inner bore 126 of the upper completion 110. The electric disconnect tool 114 can have a disconnected configuration wherein the upper portion 146 coupled to the upper completion 110 can be separated from the lower portion 148 of the electric disconnect tool 114. For example, a production tool 132 within the upper completion 110 may need to be replaced and/or repaired. In a scenario, the manipulation of the upper completion 110 by the rig 102 can disconnect the upper portion 146 coupled to the upper completion 110 from the lower portion 148 coupled to the lower completion 112. The upper completion 110 can be removed from the wellbore 106 while the lower portion 148 remains in the wellbore 106 coupled to the lower completion 112. The servicing operation can remove the upper completion 110 without damaging the upper portion 146 and lower portion 148 of the electrical disconnect tool 114. As will be further described in detail below, the upper portion 146 of the electrical disconnect tool 114 can be conveyed into the wellbore 106 coupled to the upper completion 110 (the same or a different upper completion) to be inserted (or reinserted) into an lower portion 148 coupled to the lower completion 112 and establish (or reestablish) electrical and/or hydraulic connection between the upper portion 146 and lower portion 148 of the electrical disconnect tool 114.

Figure 2A:
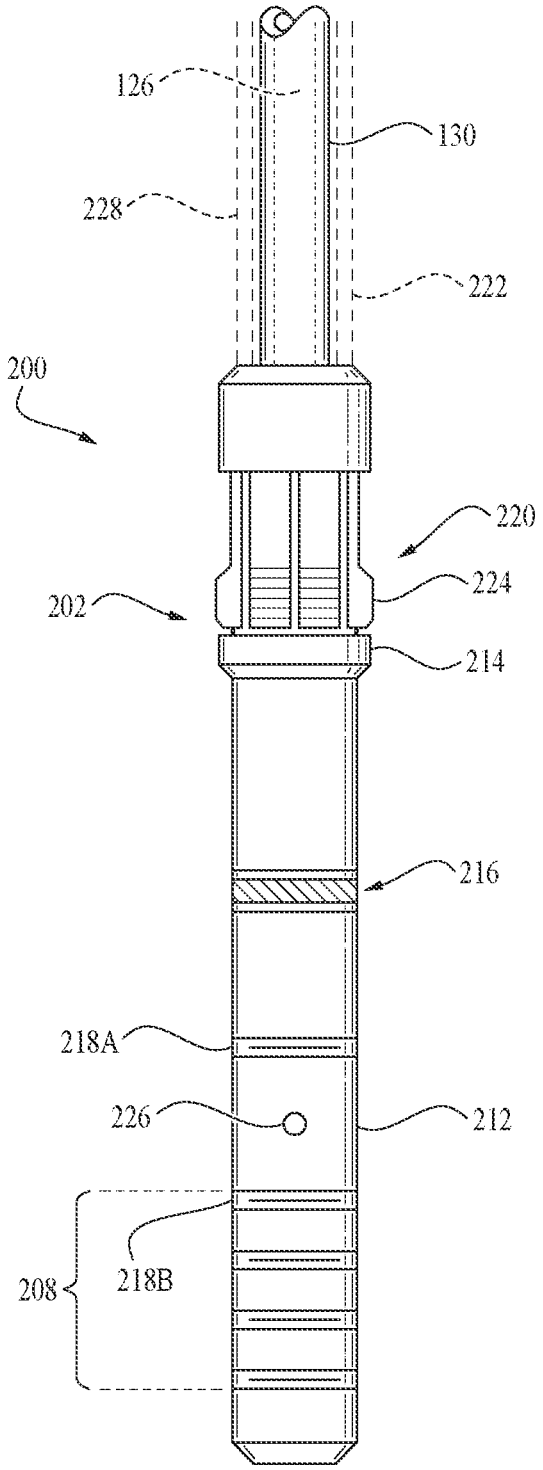
FIG. 2A is a partial sectional view of an electrical wet connect locator for the electrical wet connect assembly according to an embodiment of the disclosure.

Turning now to FIG. 2A, an electrical wet connect tool is described. In some embodiments, the electrical wet connect tool, also referred to as an electrical disconnect tool 200, electric wet connect, a wet connect, or a concentric electrical disconnect tool, can be an embodiment of the electrical disconnect tool 114. The electrical disconnect tool 200 includes a locator sub 202 and a disconnect receptacle sub 204. The locator sub 202, also referred to as the disconnect mandrel, can be configured as the male connector. The receptacle sub 204, also referred to as the disconnect receptacle, can be configured as a female electrical connector or box connector. An electrical circuit can be completed by a concentric electrical connection when the body 212 of the locator sub 202 is removably inserted into a bore 210 of the receptacle sub 204 as will be described further herein. With reference to the wellbore environment 100 shown in FIG. 1, the locator sub 202 of the electrical disconnect tool 200 can be coupled to the end of the workstring 130 of the upper completion 110, and the receptacle sub 204 of the electrical disconnect tool 200 can be coupled to the completion tubular 136 of the lower completion 112.

Figure 3A:
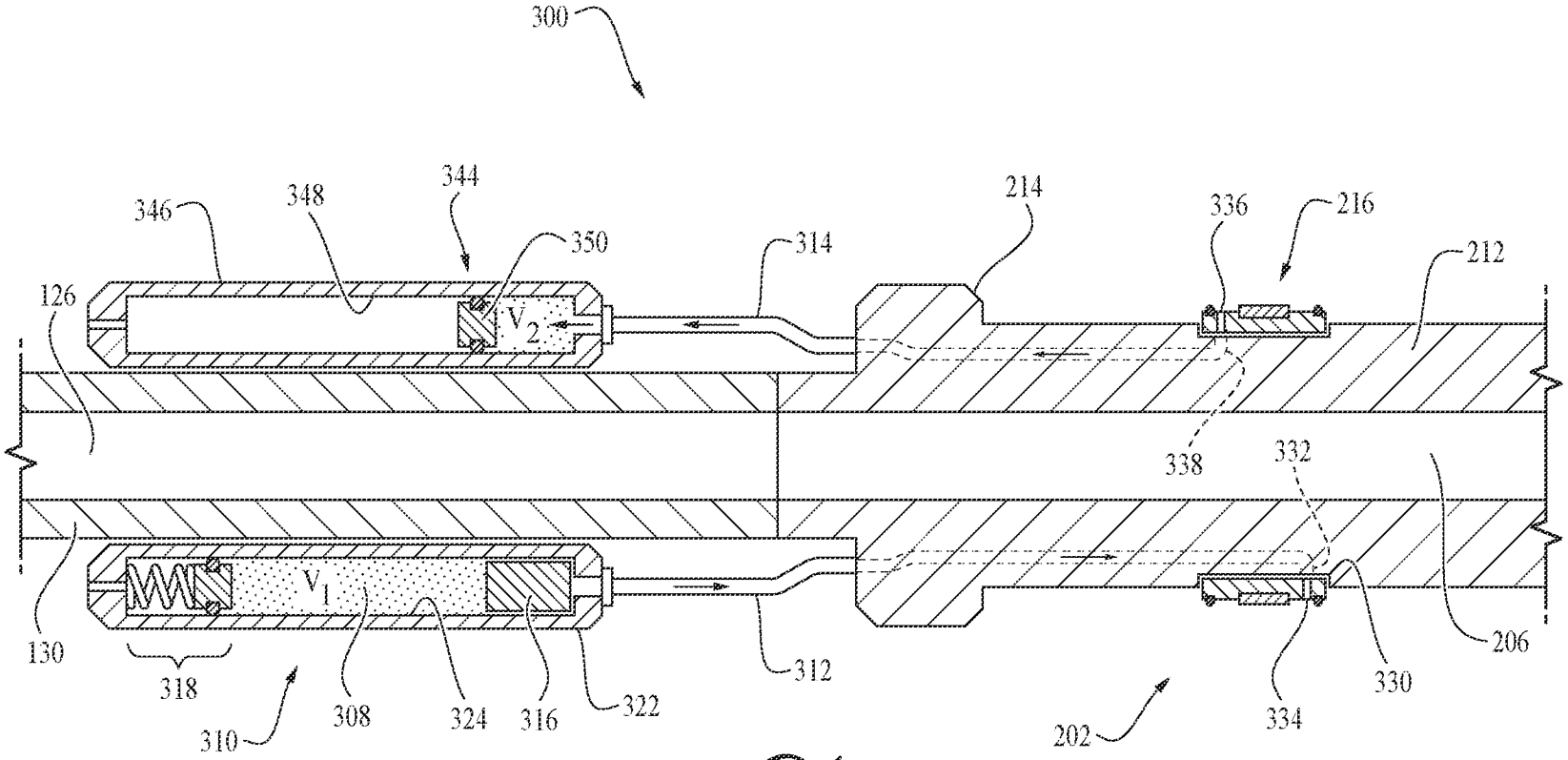
FIG. 3A is a partial sectional view of a fluid flow-path within the locator sub for the mated electrical wet connect according to an embodiment of the disclosure.

The locator sub 202 is a generally cylindrical shape with an inner bore also referred to as a flow bore 206. The locator sub 202 comprises a locator ring 214, a resilient connector 216, and at least one seal 218 on the body 212. In some embodiments, the locator ring 214 can position the locator sub 202 within the receptacle sub 204 by contacting a mating surface. The locator ring 214 can be positioned above the resilient connector 216 (e.g., towards the surface 104) of the locator sub 202. The resilient connector 216 can be a ring or band of conductive material surrounded by isolation material located on the body 212 or located in a groove on the body 212. The resilient connector 216 can be electrically coupled to a first conductor housed within an electrical conduit 222 as will be described further herein. The flow bore 206 of the locator sub 202 can be fluidically connect to the inner bore 126 of the workstring 130 as shown in FIG. 3A. The locator sub 202 can include at least one seal 218 located within a groove or recess on the body 212. In some embodiments, the locator sub 202 can comprise an array of seals 218 spaced an axial distance apart. In some embodiments, the locator ring 214 can be positioned at the bottom end, e.g., below the resilient connector 216. Although one resilient connector 216 is shown, it is understood that the locator sub 202 can have any number of resilient connector 216 and associated electric conduits 222.

In some embodiments, the locator sub 202 can include a latch mechanism 220. The latch mechanism 220 can include a set of collet fingers with a latch head 224. In some embodiments, the latch mechanism 220 can be configured with a set of collet fingers with a cantilever collet or a dual collet. In some embodiments, the latch mechanism 220 can be configured with a smooth anchor head or with a threaded latch head 224. In some embodiments, the latch mechanism 220 can be configured with a release feature to maintain the latch mechanism 220 is a locked position. For example, the latch mechanism 220 can remain in the locked position until the release feature is moved to the release position.

In some embodiments, the locator sub 202 can comprise a first hydraulic port 226 located on the body 212 between two seals 218. For example, a first hydraulic port 226 can be located between a first seal 218A and a second seal 218B. The first seal 218A and second seal 218B can be a portion of the seal array. The first hydraulic port 226 can be fluidically connected to a first hydraulic conduit 228 via a drilled passageway as will be described further herein. The hydraulic conduit 228 can be fluidically coupled to a volume of fluid, e.g., hydraulic fluid, at the surface 104. Although one hydraulic port 226 is shown, it is understood that the locator sub 202 can have any number of hydraulic ports 226 and associated hydraulic conduits 228.

Figure 2B:
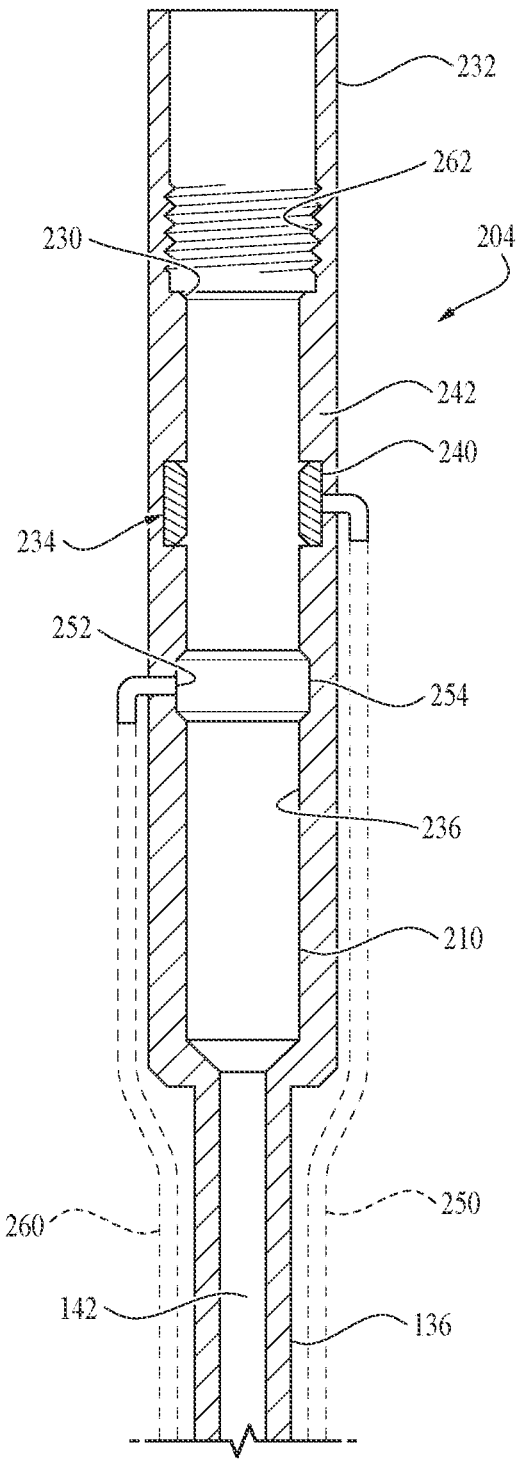
FIG. 2B is a partial sectional view of an electrical wet connect receptacle for the electrical wet connect assembly according to an embodiment of the disclosure.

Turning now to FIG. 2B, an electrical wet connect receptacle can be described. In some embodiments, the receptacle sub 204, also referred to as electrical wet connect receptacle, includes a locator shoulder 230, a ring connector 234, and a seal surface 236 within the bore 210. The receptacle sub 204 can be a generally cylindrical shape with an outer surface 232 and a bore 210. The bore 210 can be fluidically connected to the inner passage 142 of the completion tubular 136. The locator shoulder 230 can be an inner surface located above (e.g., towards the surface 104) the ring connector 234. The locator shoulder 230 can be configured to axially align the features of the locator sub 202 with the features of the receptacle sub 204 when the locator ring 214 of the locator sub 202 contacts the locator shoulder 230. For example, the ring connector 234 of the receptacle sub 204 can align with the resilient connector 216 of the locator sub 202 when the locator ring 214 contacts the locator shoulder 230. The ring connector 234 of the receptacle sub 204 can be a ring or band of conductive material surrounded by isolation material located in a groove 240 or recess within a housing 242. The ring connector 234 can be electrically coupled to a second conductor housed within an electrical conduit 250 as will be described further herein. The seal surface 236 within the bore 210 can form a seal with the seal 218 or seal array of the locator sub 202. The seal 218 can be configured to install into the bore 210 with a sliding fit and sealingly isolate the receptacle sub 204 from the wellbore fluids within the tubular 136 and fluidically connect the inner passage 142 of the completion tubular 136 to the inner bore 126 of the workstring 130 via the flow bore 206 of the locator sub 202.

In some embodiments, the receptacle sub 204 can comprise a second hydraulic port 252 within a groove 254 in the housing 242. The first hydraulic port 226 in the locator sub 202 can align with the second hydraulic port 252 in the receptacle sub 204 or locate within the groove 254 in the receptacle sub 204 in response to the locator ring 214 contacting the locator shoulder 230. The second hydraulic port 252 can be fluidically connected to a second hydraulic conduit 260 via a fitting. Although the second hydraulic conduit 260 is shown proximate to the outer surface 232 of the receptacle sub 204, it is understood that this location of the second hydraulic conduit 260 is illustrative for clarity and the second hydraulic port 252 may connect with a drilled passageway, the second hydraulic conduit 260 may be placed within a passageway, the hydraulic conduit may be placed with a groove, or combinations thereof. Although one hydraulic port 252 is shown, it is understood that the hydraulic ports 252 of the receptacle sub 204 align with the hydraulic ports 226 of the locator sub 202, thus the receptacle sub 204 can have the same number of ports as the locator sub 202.

In some embodiments, the receptacle sub 204 can include a latch profile 262 within the inner surface of the housing 242. The latch profile 262 can mate with or likewise engage the latch head 224 of the latch mechanism 220 on the locator sub 202. In some embodiments, the latch profile 262 comprises a plurality of grooves and/or a threaded profile to mate with a threaded profile of the latch head 224. The latch profile 262 can be located above the locator shoulder 230 to align with the latch head 224 of the locator sub 202 when the locator ring 214 contacts the locator shoulder 230. In some embodiments, the latch profile 262 can be located below ring connector 234. For example, the latch profile 262 can be located below the bore 210.

During servicing operations conducted on the rig 102 from FIG. 1, the locator sub 202 may be separated from the receptacle sub 204. For example, the locator sub 202 can be separated from the receptacle sub 204 during maintenance on one more downhole tools coupled to the upper completion 110. The wellbore servicing operation can reconnect the electrical disconnect tool 200 by manipulating the workstring 130 axially to insert the locator sub 202 into the receptacle sub 204. The body 212 of the locator sub 202 can be inserted into the bore 210 of the receptacle sub 204 until the locator ring 214 contacts the locator shoulder 230. As previously described, the locator ring 214 contacting the locator shoulder 230 can align the features of the locator sub 202 and the receptacle sub 204. For example, the resilient connector 216 of the locator sub 202 can align or be mated with the ring connector 234 of the receptacle sub 204. The first conductor within the electrical conduit 222 can be in electrical communication with the second conductor within the electric conduit 250 when the resilient connector 216 is mated with the ring connector 234. Similarly, the first hydraulic conduit 228 of the locator sub 202 can be fluidically connected to the second hydraulic conduit 260 of the receptacle sub 204 when the hydraulic port 226 is within the groove 254 on the housing 242 of the receptacle sub 204. The latch head 224 of the latch mechanism 220 can be mated to the latch profile 262 within the housing 242 of the receptacle sub 204.

Turning now to FIG. 3A, a fluid flowpath 300 within the locator sub for the mated electrical wet connect can be described. In some embodiments, the fluid flowpath 300 can flush wellbore fluids from an electrical wet connect in the mated configuration, e.g., electrical disconnect tool 114 from FIG. 1. The fluid flowpath 300 is illustrated with the locator sub 202 and associated features share the same numbers from FIG. 1 and FIG. 2. The fluid flowpath 300 comprises a volume V1 of flushing fluid within a flushing fluid source 310, a fluid pathway 312, the mated electrical connections, and a trigger mechanism 316. The flushing fluid can be a dielectric fluid that insulates an electrical connection, for example, transformer oil, perfluoroalkanes, hexane, mineral oil, castor oil, silicone oil, or purified water. In some embodiments, the flushing fluid comprises an alcohol or alcohol based solvent that can chemically combine with or chemically couple with conductive fluids. The fluid source 310 can be a generally cylindrical shape with an outer surface 322, an inner surface 324, and a first volume of flushing fluid labeled V1 within a chamber 308. A first fluid pathway 312 can fluidically connect the fluid source 310 with the resilient connector 216. The first fluid pathway 312 can be formed by a portion with a fluid conduit, an axial passageway, a radial passageway 332, or combinations thereof. The resilient connector 216 installed within a groove 330 on the body 212 can include an entrance port 334 and an exit port 336. The resilient connector 216, in the mated configuration, can form a fluid chamber with a set of seals engaged with the mating ring connector 234 as will be described further herein. In some embodiments, the volume V1 of flushing fluid can be provided by a chamber, a hydraulic conduit, or combinations thereof fluidically connected to the resilient connector 216. In some embodiments, the volume V1 of flushing fluid can be provided by a hydraulic conduit, e.g., a control line, extending from surface.

A second fluid pathway 314 can be fluidically connected to the resilient connector 216. The second fluid pathway 314 can be formed by a fluid conduit, an axial passageway, a radial passageway 338, or combinations thereof. The second fluid pathway 314 can be fluidically connected to the annulus, the tubing, a hydraulic conduit, or a receiving chamber. In some embodiments, the second fluid pathway 314 can be coupled to a port fluidically coupled to the annulus, e.g., the space located between the workstring 130 and the casing string 118. In some embodiments, the second fluid pathway 314 can be coupled to a port fluidically coupled to the inside of the tubing, e.g., the inner bore 126 of the workstring 130. In some embodiments, the second fluid pathway 314 can be coupled to a hydraulic conduit, e.g., hydraulic conduit 228, fluidically connected to a storage location, e.g., a storage tank, or a volume of fluid, e.g., flushing fluid, at surface 104. In some embodiments, a receiving chamber 344 can be fluidically connected to the resilient connector 216 via the second fluid pathway 314. The receiving chamber 344 can be a generally cylindrical with an outer surface 346 and an inner surface 348. The receiving chamber can include a second volume of flushing fluid labeled V2.

During the wellbore servicing operation, the locator sub 202 can be inserted into the receptacle sub 204 by manipulation of the workstring 130. A volume of flushing fluid, e.g., a first volume V1 or portion thereof, can be released from the fluid source 310 and can travel down the fluid pathway 312 to the resilient connector 216. In some embodiments, the radial passageway 332 is an annular flow path, for example, a groove or a space between an outer surface of a smaller cylinder (e.g., outer surface of the body 212), and an inner surface of the resilient connector 216. In some embodiments, the radial passageway 332 is a port formed during manufacturing, e.g., drilling operation. The first fluid pathway 312 can be sealingly and fluidically coupled to the entrance port 334 on the resilient connector 216. The volume V1 of fluid can exit the resilient connector 216 through the entrance port 334 and into the fluid chamber created by the resilient connector 216 and the ring connector 234 as will be described further herein. The volume V1 of flushing fluid can displace and/or replace trapped wellbore fluids by flowing the wellbore fluids out of the fluid chamber via an exit port 336, a second radial passageway 338, and a second fluid pathway 314. The exit port 336 on the resilient connector 216 can be sealingly and fluidically connected to the second fluid pathway 314. The radial passageway 338 may be a port, a groove, an annular space, a drill hole, or combinations thereof. The volume V1 of flushing fluid can flush or displace the trapped wellbore fluid from the fluid chamber, via the second fluid pathway 314, to the annulus, to the tubing, to the surface, or to the receiving chamber. In some embodiments, the volume V1 of flushing fluid can displace the trapped wellbore fluid to a port coupled to the annulus or the tubing. In some embodiments, the volume V1 of flushing fluid can displace the trapped wellbore fluid to the surface via a hydraulic control line.

In some embodiments, the volume V1 of flushing fluid can displace the trapped wellbore fluid and a volume of flushing fluid into a receiving chamber via the second fluid pathway 314. The receiving chamber can include a second volume V2 and a second balance piston 350 sealingly engaged with the inner surface 348 of the receiving chamber 344. The second balance piston 350 can displace axially along the inner surface 348 as the second volume V2 increases with the displaced wellbore fluid and a portion of the volume V1 of flushing fluid. In some embodiments, the receiving chamber 344 can include a flow control device or be coupled with a flow control device, for example, a check valve, a nozzle or an orifice (e.g., flow restrictor), a flow metering valve, a pressure relief valve, or combinations thereof.

The flushing fluid can be released or delivered from the fluid source 310 by a trigger mechanism 316. In some embodiments, the trigger mechanism 316 can include a fluid control device, a motive device, a communication device, or combinations thereof. For example, the trigger mechanism 316 can comprise a check valve (e.g., fluid control device), a fluid pump (e.g., motive device), and a transceiver (e.g., communication device). The servicing operation can activate the trigger mechanism 316 by communicating a signal from surface. For example, the service personnel can transmit power and commands via the electrical conduit 222 of FIG. 2 to activate the trigger mechanism 316. e.g., a fluid pump, that is communicatively coupled and/or electrically coupled to the electrical conduit 222. The communication signal can comprise a pressure signal, an acoustic signal, an electronic signal, a positional signal, or combinations thereof. A communication device comprising a controller, a signal transceiver, and a power source can receive the signal and direct the motive device per the signal. The signal receiver can include a pressure transducer, an acoustic receiver, a network communication card, or combinations thereof. In some embodiments, the communication device can be axial displacement of the workstring to provide a positional signal, e.g., a change in the position of the workstring. The trigger mechanism 316 can include a motive device 318 configured to increase the fluid pressure within the chamber 308. The fluid control device can comprise a manifold, a check valve, an orifice, a flow restrictor, a flow metering valve, a pressure relief valve, or combinations thereof. The motive device 318 can include a spring, a hydraulic pump, a compressed volume of gas, a hydrostatic piston, a motor driven extension piston, a gas generator, a balance piston with an annular port, a balance piston with a tubing port, or combinations thereof. Although the motive device 318 is illustrated on the opposite end of the fluid source 310 as the trigger mechanism 316, it is understood that the motive device 318 and the trigger mechanism can be combined and replace the motive device 318 or the trigger mechanism 316 in their respective locations.

In an embodiment, the trigger mechanism 316 can comprise a controller with a hydraulic pump electrically coupled to the electric conduit 222. A signal comprising communication and power can be transmitted from surface 104 to the trigger mechanism 316. A fluid expansion device such as a balance piston, a bladder, a set of bellows, or combinations thereof can replace the motive device 318 to change the volume V1 of the fluid source 310 as the flushing fluid is pumped into the fluid pathway 312 by the fluid pump. The controller can direct the hydraulic pump within the trigger mechanism 316 to transfer flushing fluid into the fluid pathway 312. In some embodiments, the trigger mechanism can comprise a battery, a controller, an acoustic communication device, and a hydraulic pump. The controller can receive communication from an acoustic signal transmitted from surface to the acoustic communication device communicatively coupled to the controller.

In an embodiment, the trigger mechanism 316 can comprise a manifold and a motive device 318 supplying a volume of gas. For example, the motive device 318 can include a pressurized gas source, such as a compressed volume of gas (e.g., nitrogen) or a gas generator. The gas generator can be configured to produce gas from a chemical reaction (e.g., iron sulphate and hydrogen peroxide) or from combusting a fuel source (e.g., ignition of a pyrotechnic charge). A communication device communicatively coupled to a controller can receive a signal from the surface via acoustic signal or conductor within electric conduit 222 to open a valve on a manifold and/or initiate the gas generation. A volume of compressed gas can displace the volume V1 for flushing fluid from fluid source 310 into the fluid pathway 312.

In an embodiment, the motive device 318 can comprise a hydrostatic piston retained by a lock-out feature, e.g., a trigger mechanism 316. The hydrostatic piston can comprise a piston with a trapped volume of gas at atmospheric pressure, i.e., 1 bar. The hydrostatic piston can include a first piston area (i.e., cross-sectional area) exposed to wellbore pressures and a second piston area exposed to the atmospheric gas pressure. In some embodiments, the trapped volume of gas can be lower than atmospheric pressure by applying a vacuum to the trapped volume of gas. The lock-out feature. e.g., the trigger mechanism 316, can comprise a shear device, a locking mechanism, a balance chamber, or combinations thereof. The shear device of the lock-out feature can be a set of shear pins configured to shear at a predetermined value. For example, the shear device can break (e.g., shear) when the wellbore pressure reaches a pre-determined value. In some embodiments, the shear device can break when pressure is applied to the hydrostatic pressure inside the tubing pressure, e.g., inside the workstring 130, above a predetermined value. In some embodiments, the shear device can break when pressure is applied to the annulus, e.g., between the workstring 130 and the casing string 118, above a predetermined value. In some embodiments, a locking mechanism can be unlocked by a signal communicated from the surface to a controller via a communication device to actuate a valve or rupture a disk to expose the hydrostatic piston to wellbore fluid.

In some embodiments, the motive device 318 can be a balance piston, a locking mechanism, and a fluid pathway to the annulus or tubing. The balance piston can be exposed to the wellbore pressure of the annulus or inside the tubing via the fluid pathway. The locking mechanism can be a set of shear pins or rupture disk configured to break at a predetermined pressure value. In some embodiments, pressure applied to the tubing, e.g., inside the workstring 130 can break the locking mechanism and release the balance piston. In some embodiments, pressure applied to the annulus can break the locking mechanism and release the balance piston. The applied fluid pressure to the annulus or tubing can displace the balance piston and reduce the volume V1 of fluid as the flushing fluid transfers to the fluid pathway 312.

Although one fluid source 310 is illustrated, it is understood that the fluid flowpath 300 can comprise 1, 2, 3, 4, 5, 6, 7, 8, 9, 10, or any number of fluid sources 310 fluidically coupled with at least one fluid pathway 312. Although one fluid pathway 312 is illustrated, it is understood that the fluid flowpath 300 can comprise 1, 2, 3, 4, 5, 6, 7, 8, 9, 10, or any number of one fluid pathway 312 fluidically coupled with at least one resilient connector 216. Although one resilient connector 216 is illustrated, it is understood that the locator sub 202 can comprise any number of resilient connectors 216. Although one fluid flowpath 300 is illustrated, it is understood that the locator sub 202 can comprise 1, 2, 3, 4, 5, 6, 7, 8, 9, 10, or any number of fluid flowpath 300 fluidically coupled with at least one fluid source 310. Although one resilient connector 216 with one fluid flowpath 300 is illustrated, it is understood that the locator sub 202 can have two or more resilient connector 216 fluidically connected to a corresponding fluid flowpath 300.

Figure 3B:
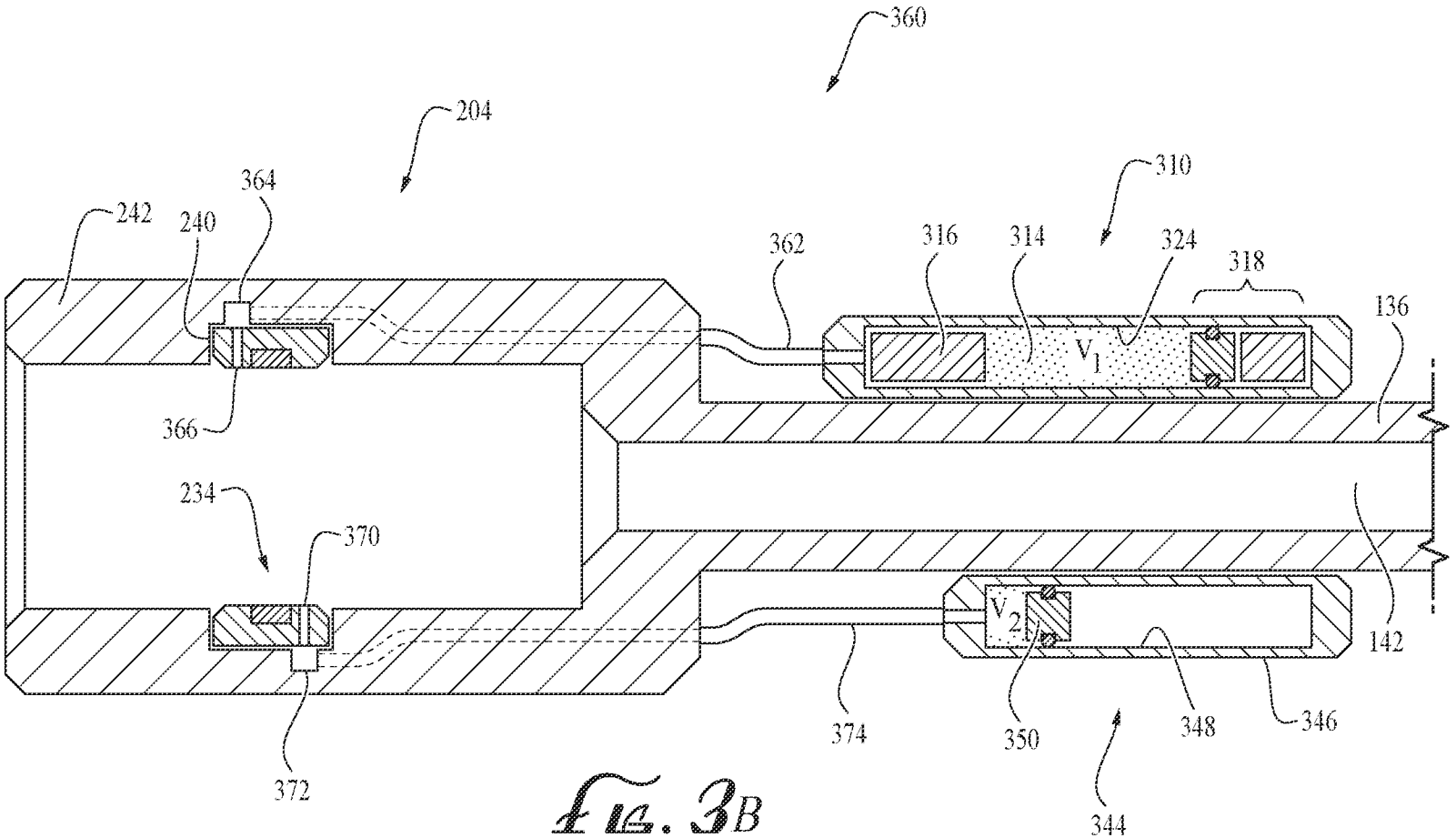
FIG. 3B is a partial sectional view of a fluid flow-path within the receptacle sub for the mated electrical wet connect according to an embodiment of the disclosure.

Turning now to FIG. 3B, a fluid flowpath 360 for the receptacle sub for the mated electrical wet connect can be described. The fluid flowpath 360 can be similar to the fluid flowpath 300 of FIG. 3A and thus similar features can share the same numbers from FIG. 1, FIG. 2, and FIG. 3A. In some embodiments, the fluid flowpath 360 can flush wellbore fluids from a mated electrical wet connect. e.g., disconnect tool 114 from FIG. 1. The fluid flowpath 360 comprises a volume of flushing fluid, a fluid source 310, a fluid pathway 362, the mated electrical connections, and a trigger mechanism 316. As previously described, the flushing fluid can be a dielectric fluid that insulates an electrical connection. The flushing fluid source 310, also referred to as fluid source, can be a generally cylindrical with an outer surface 322, an inner surface 324, and a first volume of flushing fluid labeled V1. A fluid pathway 362 can fluidically connect the fluid source 310 with the ring connector 234. The fluid pathway 362 can be formed by a fluid conduit, an axial passageway, a radial passageway 364, or combinations thereof. The ring connector 234 installed within a groove 240 in the housing 242 can include an entrance port 366 and an exit port 370. The ring connector 234 can form a fluid chamber with a set of seals engaged with the mating connector as will be described further herein. A second fluid pathway 374 can be fluidically connected to the ring connector 234. The second fluid pathway 374 can be formed by a fluid conduit, an axial passageway, a radial passageway 372, or combinations thereof. The second fluid pathway 374 can be fluidically connected to the annulus, the tubing, a hydraulic conduit, or a receiving chamber. In some embodiments, the second fluid pathway 374 can be coupled to a port fluidically coupled to the annulus. e.g., the space located between the tubular 136 and the casing string 118 or the wellbore 128. In some embodiments, the second fluid pathway 374 can be coupled to a port fluidically coupled to the inside of the tubular 136. e.g., the inner passage 142 of the tubular 136. In some embodiments, the second fluid pathway 314 can be coupled to a hydraulic conduit, e.g., hydraulic conduit 228, that extends along the outside of the tubular 136 for a portion of the distance of the wellbore 128. The hydraulic conduit can be fluidically connected to the annulus within the wellbore 128. In some embodiments, a receiving chamber 344 can be fluidically connected to the ring connector 234 via the second fluid pathway 374. The receiving chamber 344 can be a generally cylindrical with an outer surface 346 and an inner surface 348. The receiving chamber 344 can include a second volume of flushing fluid labeled V2.

The fluid flowpath 360 can operate with a similar method of operation as the previously described fluid flowpath 300.

A volume of flushing fluid, e.g., a first volume V1, can be released from the fluid source 310 by a trigger mechanism 316. The volume V1 can travel down the fluid pathway 362 to the ring connector 234. The volume V1 of fluid can exit the ring connector 234 through the entrance port 366 and into the fluid chamber created by the resilient connector 216 and the ring connector 234 as will be described further herein. As described, the fluid source 310 can be fluidically connected to the entrance port 366. The volume V1 of flushing fluid can displace and/or replace trapped wellbore fluids by flowing the wellbore fluids out of the fluid chamber via an exit port 370 and a second fluid pathway 374. The exit port 370 can be fluidically connected to the second fluid pathway 374. The volume V1 of flushing fluid can flush or displace the trapped wellbore fluid from the fluid chamber via the second fluid pathway 314. In some embodiments, the volume V1 of flushing fluid can displace the trapped wellbore fluid and a volume of flushing fluid into a receiving chamber 344 via the second fluid pathway 374.

In some embodiments, the locator sub 202 can include a first seal 218A, a hydraulic port 226, a second seal 218B, and a seal array 208 comprising a series of seals 218. The hydraulic port 226, fluidically connected to an electrical conduit 222, can form individual hydraulic passages between the first seal 218A and second seal 218B when the locator sub 202 is inserted into receptacle sub 204. Receptacle sub 204 may include at least one hydraulic port 252 that is positioned to align with hydraulic port 226 of the locator sub 202 when the locator sub 202 is fully inserted into the receptacle sub 204. The hydraulic passages and hydraulic ports 252 may be configured to form one or more fluidic connections between the locator sub 202 and the receptacle sub 204 when the locator sub 202 is fully inserted into the receptacle sub 204.

Although one fluid source 310 is illustrated, it is understood that the fluid flowpath 360 can comprise 1, 2, 3, 4, 5, 6, 7, 8, 9, 10, or any number of fluid sources 310 fluidically coupled to at least one radial passageway 364. Although one radial passageway 364 is illustrated, it is understood that the fluid flowpath 360 can comprise 1, 2, 3, 4, 5, 6, 7, 8, 9, 10, or any number of fluid pathway 312 fluidically coupled with at least one ring connector 234. Although one ring connector 234 is illustrated, it is understood that the receptacle sub 204 can comprise 1, 2, 3, 4, 5, 6, 7, 8, 9, 10, or any number of ring connectors 234. Although one ring connector 234 with one fluid flowpath 360 is illustrated, it is understood that the receptacle can have two or more ring connectors 234 fluidically connected to at least one fluid flowpath 360. Although one fluid flowpath 360 is illustrated, it is understood that the receptacle sub 204 can comprise 1, 2, 3, 4, 5, 6, 7, 8, 9, 10, or any number of fluid flowpath 360 fluidically coupled with at least one fluid source 310. Although one ring connector 234 with one fluid flowpath 360 is illustrated, it is understood that the receptacle sub 204 can have two or more ring connector 234 fluidically connected to a corresponding fluid flowpath 360.

In some embodiments, the locator sub 202 with a fluid source 310 and fluid flowpath 300 can be installed into a receptacle sub 204 with a fluid source 310 and fluid flowpath 360. For example, the locator sub 202 can include two or more resilient connectors 216 fluidically connected to at least one fluid source 310 via a fluid flowpath 300. In this example, the locator sub 202 can be installed into a receptacle sub 204 that includes two or more ring connectors 234 fluidically connected to at least one fluid source via a fluid flowpath 360. In some embodiments, the fluid flowpath 300 on the locator sub 202 can be connected to at least one resilient connector 216 and the fluid flowpath 360 on the receptacle sub 204 can be connected to a different ring connector 234 such that the fluid flowpath 300 flushes at least one electrical connection and the fluid flowpath 360 flushes at least one different electrical connection. In some embodiments, the fluid flowpath 300 on the locator sub 202 can be fluidically connected to at least one resilient connector 216 and the fluid flowpath 360 on the 22) receptacle sub 204 can be fluidically connected to a corresponding ring connector 234 such that the fluid flowpath 360 and fluid flowpath 300 can flush the same electrical connection.

Figure 4:
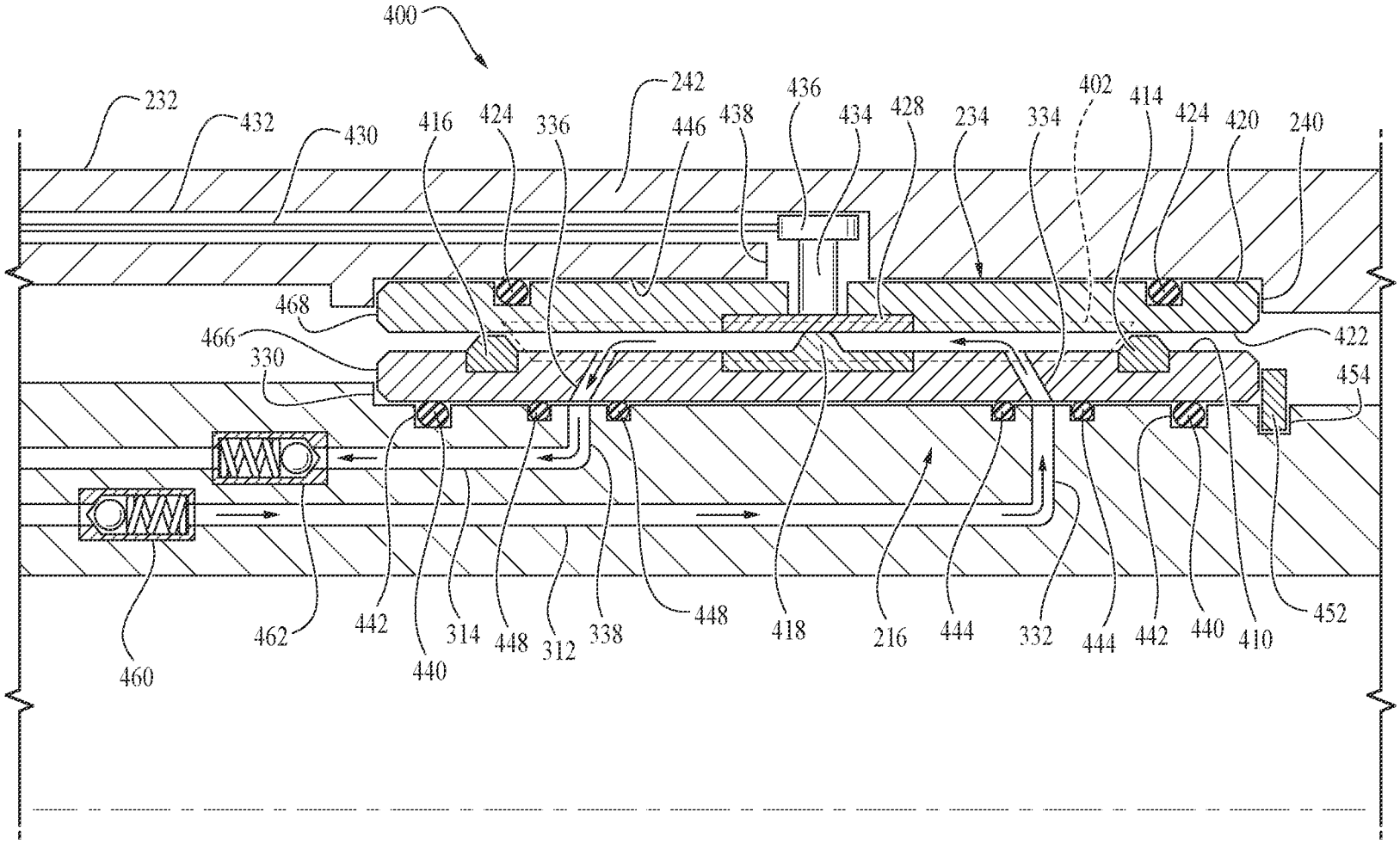
FIG. 4 is a partial sectional view of the electrical connection for the mated electrical wet connect according to an embodiment of the disclosure.

As previously described, an electrical connection can be configured when the locator sub 202 is installed into the receptacle sub 204. The electrical connection can be formed when the resilient connector 216 on the locator sub 202 is sealingly and electrically coupled with the ring connector 234 of the receptacle sub 204. A set of seals on the resilient connector 216 can sealingly engage and form a fluid chamber with the outer surface of the ring connector 234. Turning now to FIG. 4, a cross-sectional illustration of an electrical connection 400 with a fluid chamber is described.

The ring connector 234 can include an outer surface 420, an inner surface 422, an end surface 468, a set of seals 424 within mating grooves, and a ring contact 428. The ring contact 428 can be electrically coupled to a conductor cable within a passage bore 432 by a threaded post 434 and cable termination 436. The cable termination 436 can be connected to the conductor cable 430 and include a threaded port. The conductor cable can be an embodiment of the conductor cable within the electric conduit 250. The threaded post 434 can electrically couple to the ring contact 428 and pass through a port 438 to threadingly couple to the cable termination 436. The set of seals 424 can sealingly engage an inner surface 446 of the groove 240 to isolate the passage bore 432 and port 438 from wellbore fluids.

The resilient connector 216 can be a generally cylinder shape with an outer surface 410, an inner surface 412, and an end surface 466. The resilient connector 216 can include a first isolation seal 414, a second isolation seal 416, and a resilient contact 418. A set of seals 440 within seal grooves 442 on the body 212 can sealingly engage the inner surface 412 of the resilient connector 216. A first set of passage seals 444 can sealingly engage the inner surface 412 to isolate the first radial passageway 332 from wellbore environment. A second set of passage seals 448 can sealingly engage the inner surface 412 to isolate the second radial passageway 338 from wellbore environment. The resilient connector 216 can be retained within the groove 330 by a locking ring 452 installed within a locking groove 454 on the body 212. Although the resilient contact 418 is not shown electrically coupled to a conductor cable, e.g., conductor cable within electrical conduit 222, it is understood that the resilient contact 418 can be electrically coupled with a similar set of connectors including a threaded post passing through a port to a cable termination electrically connected to a conductor cable within an electrical conduit. The connection of the conductor cable via a threaded post to the resilient contact 418 is not shown for clarity of the description of the fluid flow-path passing through the electrical connection in the mated configuration.

In some embodiments, a fluid chamber 402 can be formed when the resilient connector 216 on the locator sub 202 is mated with the ring connector 234 on the receptacle. The first isolation seal 414 and second isolation seal 416 can sealingly engage the inner surface 422 of the ring connector 234. The fluid chamber 402 can be formed by the first isolation seal 414, the inner surface 422 of the ring connector 234, the second isolation seal 416, and the outer surface 410 of the resilient connector 216. The resilient contact 418 can electrically connect to the ring contact 428 of the ring connector 234 to pass electrical power, signal communication, or both. The resilient contact 418 can be formed of a single cantilever arms or double cantilever arms of electrically conductive materials, e.g., a copper alloy. In some embodiments, the resilient contact 418 can be formed of a conductive wire wound in a helical shape, e.g., spring shape. The cantilevers arms can be formed with spaces or gaps between each cantilever arm for deflection of the cantilevers arms resulting in a spring stress state to provide a normal force against the mating connector. e.g., the ring contact 428. These spaces or gaps between each cantilever arm provides a flow path for the flushing fluid to pass through the fluid chamber 402.

As previously described, a volume of flushing fluid, e.g., a first volume V1, can be released from the fluid source 310 by a trigger mechanism 316 to travel down the fluid pathway 312 to the first radial passageway 332 of the resilient connector 216. The first radial passageway 332 can be sealingly and fluidically coupled by the passage seals 444 to the entrance port 334 on the resilient connector 216. The volume V1 of fluid can exit the resilient connector 216 through the entrance port 334 and into the fluid chamber 402 to displace and/or replace trapped wellbore fluids by flowing the wellbore fluids out of the fluid chamber 402 via an exit port 336, a second radial passageway 338, and a second fluid pathway 314. The exit port 336 on the resilient connector 216 can be sealingly and fluidically coupled with a passage seal 448 to the second radial passageway 338. In some embodiments, the volume V1 of flushing fluid can displace the trapped wellbore fluid and a volume of flushing fluid into a receiving chamber via the second fluid pathway 314. In some embodiments, a first flow control device 460, e.g., a check valve, can be coupled to the fluid pathway 312. In some embodiments, a second flow control device 462. e.g., a check valve, can be coupled to the second fluid pathway 314. Although FIG. 4, illustrates the fluid chamber 402 with the fluid flow-loop passing through the locator sub 202 similar to FIG. 3A, it is understood that the fluid chamber 402 can function the same with the fluid flow-loop passing through the receptacle sub 204 in FIG. 3B.

Although the entrance port 334 and exit port 336 are described as single port, it is understood that the resilient connector 216 can have 1, 2, 3, 4, 5, 6, 7, 8, 9, 10, 11, 12, or any number of ports. For example, the resilient connector 216 can have 12 ports. e.g., entrance ports 334, equally distributed radially about the central axis. The resilient connector 216 can have the same number of entrance ports 334 and exit ports 336. In some embodiments, the resilient connector 216 has fewer exit ports 336 than entrance ports 334. In some embodiments, the total area of exit ports 336 is greater than the total area of entrance ports 334. For example, the exit ports 336 may be larger size than an equal number of entrance ports 334.

Figure 5:
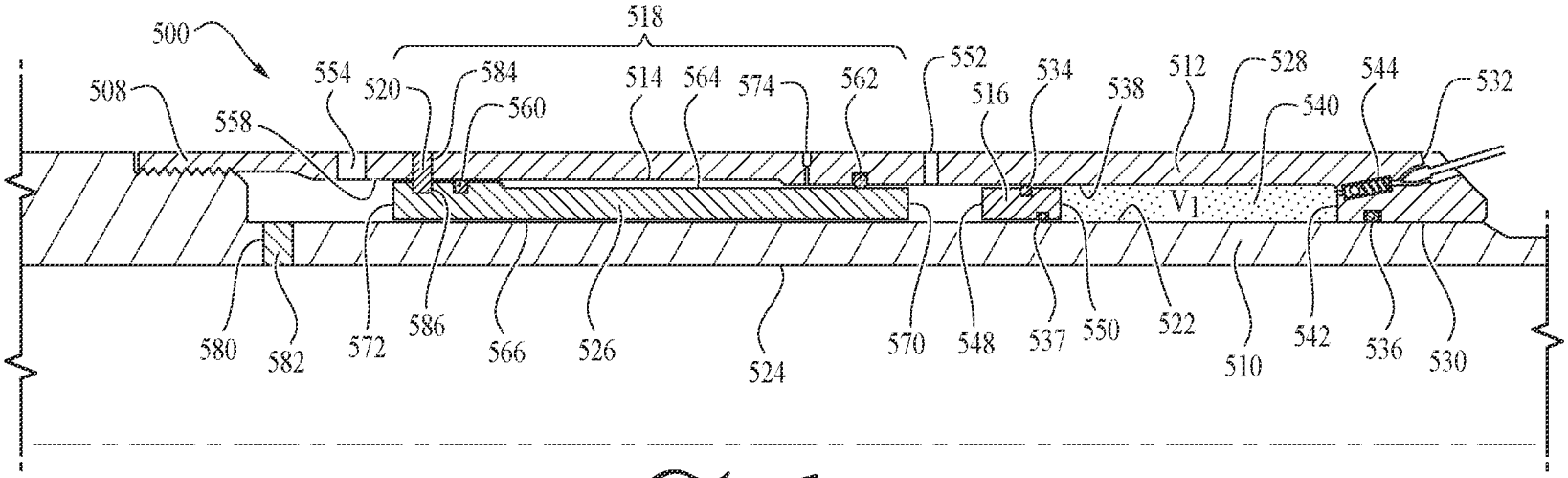
FIG. 5 is a partial sectional view of a fluid source with a trigger mechanism according to an embodiment of the disclosure.

The fluid source 310 in FIG. 3A is described as a cylinder shape coupled to the outside of the tubing, e.g., workstring 130. In some embodiments, the fluid source can be a downhole tool coupled between the tubing, e.g., workstring 130, and the locator sub 202. Turning now to FIG. 5, a fluid source 500 with a trigger mechanism is illustrated. In some embodiments, the fluid source 500 can be an embodiment of the fluid source 310 in FIG. 3A. The fluid source 500 can comprise a mandrel 510, a housing 512, and a balance piston 516. The mandrel 510 can be generally cylinder shape with an outer surface 522, an inner surface 524, and a mechanical coupling 508. The housing 512 can be a generally cylinder shape with an outer surface 528, an inner surface 530, and a conduit port 532. The housing 512 can couple to the mandrel 510 at a mechanical coupling 508 and the inner surface 530 of the housing 512 can include a seal 536 to sealingly engage the outer surface 522 of the mandrel 510. The balance piston 516 can have a sliding fit between the inner surface 538 of the housing 512 and the outer surface 522 of the mandrel 510. The balance piston 516 can include an outer seal 534 to sealingly engage the inner surface 538 and an inner seal 537 to sealingly engage the outer surface 522. A fluid chamber 540 can be formed between the inner surface 538 and end surface 542 of the housing 512, the outer surface 522 of the mandrel 510 and a front end surface 550 of the balance piston 516. The fluid chamber 540 can include a volume V1 of flushing fluid. The balance piston 516 can have a back end surface 548 in contact with wellbore fluids via a first port 552 in the housing 512. The balance piston 516 can apply wellbore pressure to the volume V1 of flushing fluid in the fluid chamber 540. The conduit port 532 can be fluidically connected to the fluid chamber 540. In some embodiments, a flow control device 544 can be located between the fluid chamber 540 and the conduit port 532. The flow control device 544 can be a check valve, a nozzle or an orifice (e.g., flow restrictor), a flow metering valve, a pressure relief valve, or combinations thereof. The flow control device 544 can be an embodiment of the flow control device 460 in FIG. 4.

In some embodiments, the fluid source 500 can comprise a motive device 518 with a locking device 520. The motive device 518 can be a hydrostatic piston comprising knocker piston 526 and an activation chamber 514. The knocker piston 526 can be a generally cylinder shape with an outer surface 564, an inner surface 566, a front end surface 570, and a back end surface 572. The knocker piston 526 can include an outer seal 560 sealingly engaging an inner surface 558 of the housing 512. An inner seal 562 on the housing 512 can sealingly engage the outer surface 564 of the knocker piston 526. The activation chamber 514 can be bounded by the outer seal 560, the inner surface 558, the inner seal 562, and the outer surface 564. The activation chamber 514 can contain a volume of gas (e.g., air) above atmospheric pressure, at or near atmospheric pressure, or below atmospheric pressure. In some embodiments, the volume of gas may be pressurized above atmospheric pressure. For example, a trigger mechanism that activates with a predetermined hydrostatic pressure within the wellbore may require the activation chamber 514 to be pressurized to a designated value. In some embodiments, the activation chamber may be an atmospheric chamber with air at or near atmospheric pressure, i.e., 1 bar. In some embodiments, a vacuum port 574 can be utilized to lower the gas pressure below atmospheric pressure. The vacuum port 574 can be sealed with a suitable plug or flow control device.

In some embodiments, the locking device 520 can comprise a shearable device, for example, a shear pin. The locking device 520, e.g., shear pin, can be installed through a pin port 584 on the housing 512 and into a shear port 586 on the knocker piston 526. The shear port 586 can be a port, a groove, or any similar feature capable of receiving the shearable device. The locking device 520 can retain the knocker piston 526 in a first position, e.g., the run-in position. The locking device 520 can shear or break at a predetermined value.

The locator sub 202 of FIG. 2 with the fluid source 500 can be conveyed into the wellbore 106 of FIG. 1. The hydrostatic pressure of the wellbore environment can increase as the fluid source 500 and locator sub 202 reach the receptacle sub 204 at a target depth. The hydrostatic pressure of the wellbore environment produces an activation force in response to the cross-sectional area of the activation chamber 514 and the differential pressure between the atmospheric pressure, e.g., 1 bar, within the activation chamber 514 and the hydrostatic pressure of the wellbore fluids. The locator sub 202 can be installed into the receptacle sub 204. The service personnel at the surface may send a signal comprising power and/or communication from the control system 144 to determine if the resilient connector 216 and ring connector 234 are properly mated. After the personnel have determined a successful mating, the service personnel may apply pressure to the wellbore 106. For example, the service personnel may begin pumping fluid into the annular space between the casing string 118 and the upper completion 110. The pumping operation can increase the hydrostatic wellbore pressure above a threshold limit to unlock the locking device 520. For example, the locking device 520, e.g., shear pin, can shear or break and thus release the knocker piston 526. The activation force, in response to the differential pressure across the cross-sectional area of the activation chamber 514, can push the knocker piston 526 into contact with the balance piston 516 and increase the pressure of the fluid chamber 540. The increase in the pressure of the flushing fluids within the fluid chamber 540 can transfer the volume V1 of flushing fluids through the conduit port 532 and into the passage, e.g., fluid pathway 312 of FIG. 3A. The flow control device 544 can regulate the flowrate and pressure of the flushing fluids entering the passage. For example, the flow control device 544 can be a pressure regulator.

The fluid source 500 can be activated with pressure applied to the annulus, e.g., the space between the casing string 118 and the upper completion 110, or with pressure applied down the bore of the tubing, e.g., workstring 130. In some embodiments, the fluid source 500 can be activated with pressure applied down the annulus by including a plug 582 sealing coupled with a port 580 on the mandrel 510 and a port 554 without a plug on the housing 512. In some embodiments, the fluid source 500 can be activated with pressure applied down the bore of the tubing, e.g., workstring 130, by including port 580 without a plug on the mandrel 510 and an sealingly coupling the plug 582 to the port 554 on the housing 512.

Figure 6:
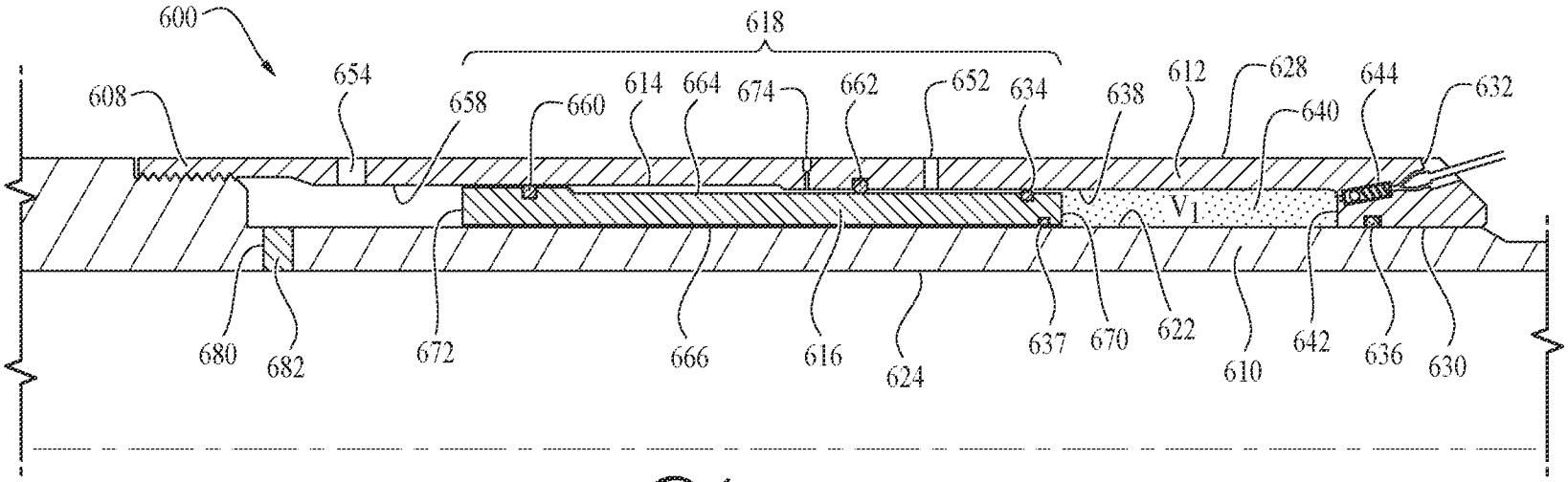
FIG. 6 is a partial sectional view of a fluid source with a motive device according to another embodiment of the disclosure.

A triggering mechanism to retain the flushing fluid within a fluid source until activated can be located on another device or away from the fluid source. For example, the fluid source 500 was described with a triggering device within the fluid source 500. A triggering device can be located away from the fluid source. Turning now to FIG. 6, a fluid source 600 with a motive device is illustrated. In some embodiments, the fluid source 600 can be an embodiment of the fluid source 310 in FIG. 3A and be fluidically coupled to the triggering mechanism 390 in FIG. 3C. The fluid source 600 can comprise a mandrel 610, a housing 612, and a motive device 618. The mandrel 610 can be a generally cylinder shape with an outer surface 622, an inner surface 624, and a pin end. The housing 612 can be a generally cylinder shape with an outer surface 628, an inner surface 630, and a conduit port 632. The housing 612 can couple to the mandrel 610 at a mechanical coupling 608 and the inner surface 630 of the housing 612 can include a seal 636 to sealingly engage the outer surface 622 of the mandrel 610. The motive device 618 can include a knocker piston 616 and an activation chamber 614. The knocker piston 616 can be a generally cylinder shape with an outer surface 664, an inner surface 666, a front end surface 670, and a back end surface 672. The knocker piston 616 can include an outer seal 660 sealingly engaging an inner surface 658 of the housing 612. An inner seal 662 on the housing 612 can sealingly engage the outer surface 664 of the knocker piston 616. The activation chamber 614 can be bounded by the outer seal 660, the inner surface 658, the inner seal 662, and the outer surface 664. The activation chamber 614 can contain a volume of gas (e.g., air) above atmospheric pressure, at or near atmospheric pressure, or below atmospheric pressure. The activation chamber 614 can contain air at or near atmospheric pressure, e.g., 1 bar. In some embodiments, a vacuum port 674 can be utilized to decrease the gas pressure below atmospheric pressure inside the activation chamber 614. The vacuum port 674 can be sealed with a suitable plug or flow control device.

A fluid chamber 640 can be formed between the inner surface 638 and end surface 642 of the housing 612, the outer surface 622 of the mandrel 610 and a front end surface 670 of the knocker piston 616. The fluid chamber 640 can include a volume V1 of flushing fluid. The housing 612 can include a first port 652 to allow wellbore fluids into chamber formed between the seal 634 and the inner seal 662. The knocker piston 616 can have a back end surface 672 in contact with wellbore fluids via a second port 654 in the housing 612. The knocker piston 616 can apply wellbore pressure against an resultant force from the atmospheric chamber, to the volume V1 of flushing fluid in the fluid chamber 640. The conduit port 632 can fluidically connect the fluid chamber 540 to the fluid pathway 312 of FIG. 3C. In some embodiments, a flow control device 644 can be located between the fluid chamber 540 and the conduit port 532. The flow control device 544 can be a check valve, a nozzle or an orifice (e.g., flow restrictor), a flow metering valve, a pressure relief valve, or combinations thereof. The flow control device 544 can be an embodiment of the flow control device 460 in FIG. 4.

Figure 3C:
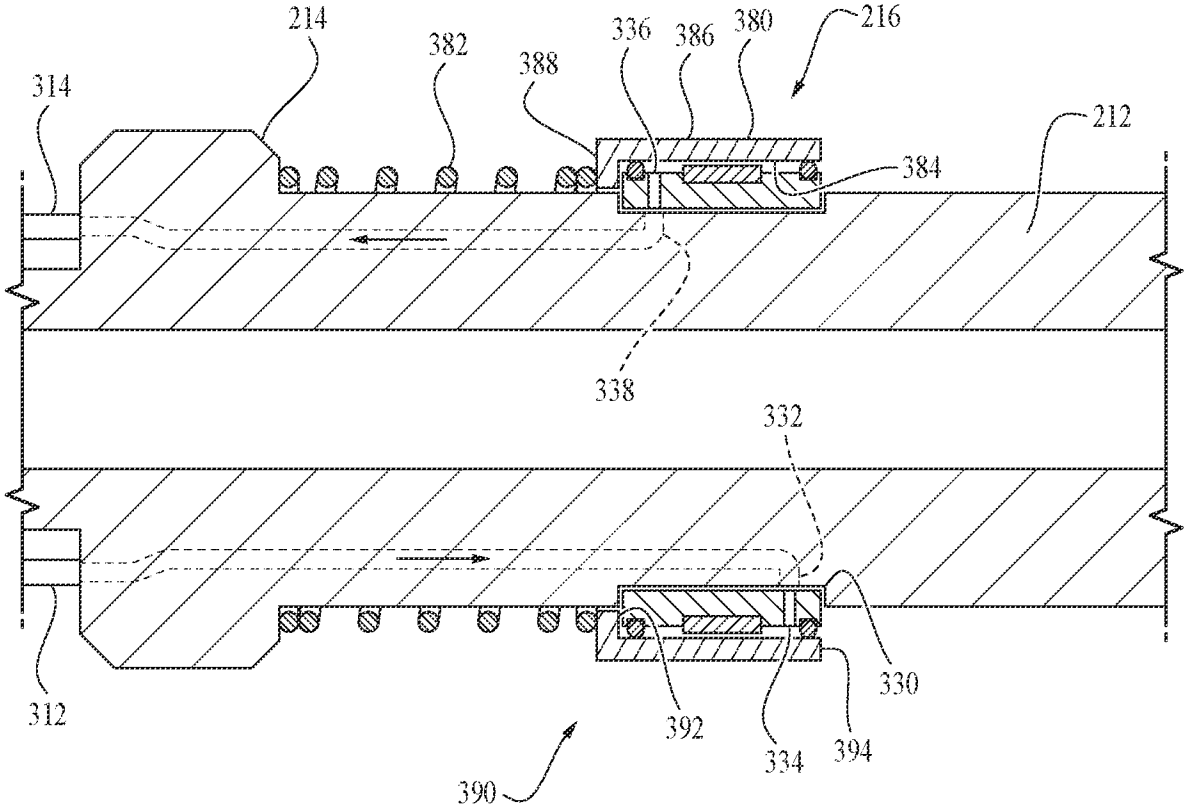
FIG. 3C is a partial sectional view of a trigger mechanism for the locator sub according to an embodiment of the disclosure.

Turning now to FIG. 3C, the triggering mechanism 390 can comprise an isolation sleeve 380 and a retaining spring 382. The isolation sleeve 380 can be generally cylinder shape with an outer surface 386, an inner surface 384, an outer end surface 388, and an inner end surface 392. The retaining spring 382 can be a coil spring with round, square, or rectangular shaped cross-section. The retaining spring 382 can be exerting a resultant force from a level of spring stress retained during assembly. The resultant force of the retaining spring 382 can position the isolation sleeve 380 with the inner end surface 392 in contact with the end surface 466 (as shown in FIG. 4) of the resilient connector 216. The first isolation seal 414 and the second isolation seal 416 of the resilient connector 216 can sealingly engage the inner surface 384 of the isolation sleeve 380. In some embodiments, the exit port 336 can be isolated by a second set of seals. In some embodiments, the second fluid pathway 314 can be blocked, isolated, or otherwise fluidically disconnected from the wellbore environment or the receiving chamber 344 from FIG. 3A.

The operation of the locator with the fluid source 600 can now be described. The locator sub 202 with the triggering mechanism 390 of FIG. 3C and the fluid source 600 can be conveyed into the wellbore 106 of FIG. 1. The hydrostatic pressure of the wellbore environment can increase as the fluid source 600 and locator sub 202 reach the receptacle sub 204 at a target depth. The hydrostatic pressure of the wellbore environment produces an activation pressure within the volume V1 of flushing fluid by the knocker piston 616 in response to a resultant force from the cross-sectional area of the activation chamber 614 and the differential pressure between the atmospheric pressure within the activation chamber 614 and the hydrostatic pressure of the wellbore fluids. The activation pressure within the volume V1 can urge the flushing fluid to transfer into the fluid pathway 312 to travel to the resilient connector 216. The triggering mechanism 390 shown in FIG. 3C can isolate the entrance port 334, the exit port 336, or both to prevent the fluid from flowing through the fluid pathway 312 to exit the entrance port 334. The locator sub 202 can be installed into the receptacle sub 204 with axial manipulation of the workstring. As the locator sub 202 is axially displaced into the receptacle sub 204, the front end 394 of the isolation sleeve 380 can abut the end surface 468 of the ring connector 234 located within the receptacle sub 204. The displacement of the locator sub 202 can axially displace the isolation sleeve 380 from the resilient connector 216 and compress the spring 382. The flushing fluid can flow through the fluid pathway 312 to exit the entrance port 334 as the isolation sleeve 380 is moved from of sealing engagement with the first isolation seal 414. The flow rate of the flushing fluid through the fluid pathway 312 can be a function of the activation pressure with the volume V1, the flow control device 644, and the geometry of the entrance port 334. The axial motion of the locator sub 202 can mate the resilient connector 216 to the ring connector 234 within the receptacle sub 204. The flushing fluid can transfer from entrance port 334, through the fluid chamber 402, and into exit port 336 when the resilient connector 216 is fully mated with ring connector 234 as shown in FIG. 4. The triggering mechanism 390 can be re-engaged by the spring 382. e.g., the isolation sleeve 380 can cover the resilient connector 216, by removing the locator sub 202 from the receptacle sub 204.

ADDITIONAL DISCLOSURE

The following are non-limiting, specific embodiments in accordance with the present disclosure.

A first embodiment, which is a downhole tool, comprising: an electrical disconnect tool 200 comprising a locator sub 202 and a receptacle sub 204, wherein the locator sub and receptacle sub engage to provide an electrical connection; a fluid source 310 in fluid communication via a fluid flowpath 300 with the electrical connection via the locator sub 202, the receptacle sub 204, or both; and a trigger mechanism 316 coupled to the fluid source 310, wherein upon activation of the trigger mechanism 316 a volume of flushing fluid is provided from the fluid source 310 to the locator sub 202, the receptacle sub 204, or both.

A second embodiment, which is the downhole tool of the first embodiment, wherein the locator sub and receptacle sub engage to provide a hydraulic connection.

A third embodiment, which is the downhole tool of the first or the second embodiment, wherein the locator sub and receptacle sub engage to provide a flow pathway for production fluids.

A fourth embodiment, which is the downhole tool of any of the first through the third embodiments, wherein the locator sub 202 comprises: a body 212 with a generally cylindrical shape and a flow bore; a conductor within an electrical conduit 222 electrically coupled to a control system 144; and a resilient connector 216 electrically coupled to the conductor.

A fifth embodiment, which is the downhole tool of the fourth embodiment, wherein the locator sub 202 further comprises: at least one seal 218 coupled to the body 212; and a hydraulic port 226 fluidically coupled to a hydraulic conduit 228.

A sixth embodiment, which is the downhole tool of any of the first through the fifth embodiments, wherein the receptacle sub 204 comprises: a housing 242 with a generally cylindrical shape with a bore 210; a conductor within an electrical conduit 250 electrically coupled to at least one downhole tool 138; and a ring connector 234 electrically coupled to the conductor.

A seventh embodiment, which is the downhole tool of the sixth embodiment wherein the receptacle sub 204 further comprises: a hydraulic port 252 fluidically connected to a hydraulic conduit 260.

An eighth embodiment, which is the downhole tool of any of the first through the seventh embodiments, wherein the fluid source 310 includes a volume of flushing fluid within a chamber 308.

A ninth embodiment, which is the downhole tool of any of the first through the eighth embodiments, wherein the trigger mechanism 316 comprises a motive device 318, a communication device, a fluid control device, or combinations thereof; wherein the motive device 318 comprises one selected from a group comprising i) spring, ii) a hydraulic pump, iii) a compressed volume of gas, iv) a hydrostatic piston, v) a motor driven extension piston, vi) a gas generator, vii) a balance piston with an annular port, or viii) a balance piston with a tubing port; wherein the fluid control device comprises i) a manifold, ii) a check valve, iii) an orifice, iv) a flow restrictor, v) a flow metering valve, vi) a pressure relief valve, or vii) combinations thereof; wherein the communication device comprises a controller, a signal transceiver, and a power source; and wherein the signal transceiver comprises a pressure transducer, an acoustic transceiver, a network communication card, or combinations thereof.

A tenth embodiment, which is the downhole tool of any of the first through the ninth embodiments, wherein the fluid flowpath 300 comprises a first fluid pathway 312, at least one entrance port 334, a flow chamber 402, at least one exit port 336, and wherein the flow chamber 402 is formed by the electrical connection in a mated configuration.

An eleventh embodiment, which is the downhole tool of any of the first through the tenth embodiments, wherein: the fluid source 500 comprises a fluid chamber 540 with the volume of flushing fluid; wherein the fluid chamber 540 is formed with a balance piston 516 movably and sealingly engaged with a housing 512; and wherein wellbore hydrostatic pressure is transferred to the volume of flushing fluid via a back end surface 548 of the balance piston 516.

A twelfth embodiment, which is the downhole tool of any of the first through the eleventh embodiments, wherein the trigger mechanism 518 comprises: a motive device 518 comprising an activation chamber 514 formed with a knocker piston 526 movably and sealingly engaged with a housing 512; and a locking device 520 comprising a shearable pin; wherein the knocker piston 526 produces an activation force in response to a pressure differential between wellbore hydrostatic pressure and a volume of gas within the activation chamber 514; wherein the locking device 520 is coupled to a pin port 584 in the housing 512 and a shear port 586 in the knocker piston 526; wherein the locking device 520 is configured to release the motive device 518 in response to the activation force exceeding a shear value of the locking device 520; and wherein the motive device 518 is configured to activate in response to release of the locking device 520.

A thirteenth embodiment, which is the downhole tool of any of the first through the twelfth embodiments, wherein the fluid source 600 comprises: a fluid chamber 640 with the volume of flushing fluid; and a motive device 618 comprising an activation chamber 614 formed with a knocker piston 616 movably and sealingly engaged with a housing 612; wherein the fluid chamber 640 is formed with the knocker piston 616 movably and sealingly engaged with a housing 612; wherein the motive device 618 produces an activation force in response to a pressure differential between wellbore hydrostatic pressure and a volume of gas below atmospheric pressure, at atmospheric pressure, or above atmospheric pressure within the activation chamber 614; and wherein the volume of flushing fluid is pressurized by the knocker piston 616 via the activation force.

A fourteenth embodiment, which is the downhole tool of any of the first through the thirteenth embodiments, wherein the trigger mechanism 390 comprises: an isolation sleeve 380 with a generally cylinder shape with an inner surface 384 movingly and sealingly engaged with a second isolation seal 416 and first isolation seal 414 on a connector 216; and a retaining spring 382 configured to bias the isolation sleeve 380 into a first configuration; wherein the first configuration retains the volume of flushing fluid within a fluid source 640; wherein a second configuration releases the volume of flushing fluid from the fluid source 640 into the fluid pathway 312; and wherein connection of the electrical connection via workstring manipulation displaces the isolation sleeve 380 from the first configuration to a second configuration.

A fifteenth embodiment, which is the downhole tool of any of the first through the fourteenth embodiments, wherein the flushing fluid comprises transformer oil, perfluoroalkanes, mineral oil, castor oil, silicone oil, hexane, or purified water.

A sixteenth embodiment, which is a method of connecting a downhole tool assembly, comprising: conveying a locator sub with at least one resilient connector into a wellbore coupled to a workstring, wherein the at least one resilient connector is electrically coupled to a control system; installing the locator sub into a receptacle sub with at least one ring connector 234 electrically coupled to a downhole device 138 and wherein the receptacle sub and at least one downhole device 138 are coupled to a tubular 136; connecting at least one electrical connection comprising the at least one resilient connector and the at least one ring connector; activating a triggering mechanism with a communication signal; and flushing the at least one electrical connection with a flushing fluid from a fluid source via a fluid flowpath in response to the triggering mechanism being activated.

A seventeenth embodiment, which is the method of the sixteenth embodiment, wherein: the resilient connector is electrically coupled to a conductor; wherein the conductor is electrically coupled to the control system; wherein the ring connector is electrically coupled to a conductor; wherein the conductor is electrically coupled to the at least one downhole device; and wherein the at least one electrical connection electrically couples the control system to the at least one downhole device.

An eighteenth embodiment, which is the method of the sixteenth or the seventeenth embodiment, wherein the communication signal is a pressure signal, an acoustic signal, an electronic signal, a positional signal, or combinations thereof.

A nineteenth embodiment, which is the method of any of the sixteenth through the eighteenth embodiments, further comprising: sealingly engaging a bore on the receptacle sub with two seals on the locator sub; fluidically coupling a first hydraulic port between the two seals on the locator sub and a second hydraulic port on the receptacle sub; and wherein a first hydraulic conduit coupled to the locator sub is fluidically coupled to a second hydraulic conduit coupled to the receptacle sub in response to the fluidic coupling of the first hydraulic port on the locator sub to the second hydraulic port on the receptacle sub.

A twentieth embodiment, which is a method of coupling an electrical connection in a wellbore, comprising: aligning a resilient connector with a ring connector; forming a flushing chamber by sealingly engaging an inner surface of the ring connector with a first isolation seal and a second isolation seal of the resilient connector; contacting a plate contact with a resilient contact, wherein the resilient connector is electrically connected to the ring connector by the plate contact; and flushing the flushing chamber with a volume of flushing fluid in response to a communication signal.

A twenty-first embodiment, which is the method of the twentieth embodiment, further comprising: activating a trigger mechanism with the communication signal; and releasing the volume of flushing fluid from a fluid source in response to activation of a trigger mechanism.

A twenty-second embodiment, which is the method of the twentieth or the twenty-first embodiment, further comprising: displacing a volume of trapped fluid within the flushing chamber with the volume of flushing fluid via a fluid flowpath.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A downhole tool, comprising:

an electrical disconnect tool comprising a locator sub and a receptacle sub, wherein the locator sub and receptacle sub engage to provide an electrical connection;

a fluid source in fluid communication via a fluid flowpath with the electrical connection via the locator sub, the receptacle sub, or both; and a trigger mechanism coupled to the fluid source, wherein upon activation of the trigger mechanism a volume of flushing fluid is provided from the fluid source to the locator sub, the receptacle sub, or both, wherein the fluid flowpath comprises a first fluid pathway, at least one entrance port, a flow chamber, at least one exit port, and wherein the flow chamber is formed by the electrical connection in a mated configuration.

2. The downhole tool of claim 1, wherein the locator sub and receptacle sub engage to provide a hydraulic connection.

3. The downhole tool of claim 1, wherein the locator sub comprises:

a body with a generally cylindrical shape and a flow bore;

a conductor within an electrical conduit electrically coupled to a control system; and a resilient connector electrically coupled to the conductor.

4. The downhole tool of claim 3, wherein the locator sub further comprises:

at least one seal coupled to the body; and a hydraulic port fluidically coupled to a hydraulic conduit.

5. The downhole tool of claim 1, wherein the receptacle sub comprises:

a housing with a generally cylindrical shape with a bore;

a conductor within an electrical conduit electrically coupled to at least one downhole tool; and a ring connector electrically coupled to the conductor.

6. The downhole tool of claim 5, wherein the receptacle sub further comprises:

a hydraulic port fluidically connected to a hydraulic conduit.

7. The downhole tool of claim 1, wherein the trigger mechanism comprises a motive device, a communication device, a fluid control device, or combinations thereof, wherein the motive device comprises one selected from a group comprising i) spring, ii) a hydraulic pump, iii) a compressed volume of gas, iv) a hydrostatic piston, v) a motor driven extension piston, vi) a gas generator, vii) a balance piston with an annular port, or viii) a balance piston with a tubing port;

wherein the fluid control device comprises i) a manifold, ii) a check valve, iii) an orifice, iv) a flow restrictor, v) a flow metering valve, vi) a pressure relief valve, or vii) combinations thereof, wherein the communication device comprises a controller, a signal transceiver, and a power source; and wherein the signal transceiver comprises a pressure transducer, an acoustic transceiver, a network communication card, or combinations thereof.

8. The downhole tool of claim 1, wherein:

the fluid source comprises a fluid chamber with the volume of flushing fluid;

wherein the fluid chamber is formed with a balance piston movably and sealingly engaged with a housing; and wherein wellbore hydrostatic pressure is transferred to the volume of flushing fluid via a back end surface of the balance piston.

9. The downhole tool of claim 1, wherein the trigger mechanism comprises:

a motive device comprising an activation chamber formed with a knocker piston movably and sealingly engaged with a housing; and a locking device comprising a shearable pin;

wherein the knocker piston produces an activation force in response to a pressure differential between wellbore hydrostatic pressure and a volume of gas within the activation chamber;

wherein the locking device is coupled to a pin port in the housing and a shear port 86 in the knocker piston;

wherein the locking device is configured to release the motive device in response to the activation force exceeding a shear value of the locking device; and wherein the motive device is configured to activate in response to release of the locking device.

10. The downhole tool of claim 1, wherein the fluid source comprises:

a fluid chamber with the volume of flushing fluid; and a motive device comprising an activation chamber formed with a knocker piston movably and sealingly engaged with a housing;

wherein the fluid chamber is formed with the knocker piston movably and sealingly engaged with a housing;

wherein the motive device produces an activation force in response to a pressure differential between wellbore hydrostatic pressure and a volume of gas below atmospheric pressure, at atmospheric pressure, or above atmospheric pressure within the activation chamber; and wherein the volume of flushing fluid is pressurized by the knocker piston via the activation force.

11. The downhole tool of claim 1, wherein the trigger mechanism comprises:

an isolation sleeve with a generally cylinder shape with an inner surface movingly and sealingly engaged with a second isolation seal and first isolation seal on a connector; and a retaining spring configured to bias the isolation sleeve into a first configuration;

wherein the first configuration retains the volume of flushing fluid within a fluid source;

wherein a second configuration releases the volume of flushing fluid from the fluid source into the fluid pathway; and wherein connection of the electrical connection via workstring manipulation displaces the isolation sleeve from the first configuration to a second configuration.

12. The downhole tool of claim 1, wherein the flushing fluid comprises transformer oil, perfluoroalkanes, mineral oil, castor oil, silicone oil, hexane, or purified water.

13. A method of connecting a downhole tool assembly, comprising:

conveying a locator sub with at least one resilient connector into a wellbore coupled to a workstring, wherein the at least one resilient connector is electrically coupled to a control system;

installing the locator sub into a receptacle sub with at least one ring connector electrically coupled to a downhole device and wherein the receptacle sub and at least one downhole device are coupled to a tubular;

sealingly engaging a bore on the receptacle sub with two seals on the locator sub;

fluidically coupling a first hydraulic port between the two seals on the locator sub and a second hydraulic port on the receptacle sub, wherein a first hydraulic conduit coupled to the locator sub is fluidically coupled to a second hydraulic conduit coupled to the receptacle sub in response to the fluidic coupling of the first hydraulic port on the locator sub to the second hydraulic port on the receptacle sub;

connecting at least one electrical connection comprising the at least one resilient connector and the at least one ring connector;

activating a triggering mechanism with a communication signal; and flushing the at least one electrical connection with a flushing fluid from a fluid source via a fluid flowpath in response to the triggering mechanism being activated.

14. The method of claim 13, wherein:

the resilient connector is electrically coupled to a conductor;

wherein the conductor is electrically coupled to the control system;

wherein the ring connector is electrically coupled to a conductor;

wherein the conductor is electrically coupled to the at least one downhole device; and wherein the at least one electrical connection electrically couples the control system to the at least one downhole device.

15. The method of claim 13, wherein the communication signal is a pressure signal, an acoustic signal, an electronic signal, a positional signal, or combinations thereof.

16. A downhole tool, comprising:

an electrical disconnect tool comprising a locator sub and a receptacle sub, wherein the locator sub and receptacle sub engage to provide an electrical connection;

a fluid source in fluid communication via a fluid flowpath with the electrical connection via the locator sub, the receptacle sub, or both; and a trigger mechanism coupled to the fluid source, wherein upon activation of the trigger mechanism a volume of flushing fluid is provided from the fluid source to the locator sub, the receptacle sub, or both, wherein the trigger mechanism comprises:

a motive device comprising an activation chamber formed with a knocker piston movably and sealingly engaged with a housing; and a locking device comprising a shearable pin;

wherein the knocker piston produces an activation force in response to a pressure differential between wellbore hydrostatic pressure and a volume of gas within the activation chamber;

wherein the locking device is coupled to a pin port in the housing and a shear port in the knocker piston;

wherein the locking device is configured to release the motive device in response to the activation force exceeding a shear value of the locking device; and wherein the motive device is configured to activate in response to release of the locking device.

17. The downhole tool of claim 16, wherein the locator sub comprises:

a body with a generally cylindrical shape and a flow bore;

a conductor within an electrical conduit electrically coupled to a control system;

a resilient connector electrically coupled to the conductor;

at least one seal coupled to the body; and a hydraulic port fluidically coupled to a hydraulic conduit, and wherein the receptacle sub comprises:

a housing with a generally cylindrical shape with a bore;

a conductor within an electrical conduit electrically coupled to at least one downhole tool;

a ring connector electrically coupled to the conductor; and a hydraulic port fluidically connected to a hydraulic conduit.

18. A downhole tool, comprising:

an electrical disconnect tool comprising a locator sub and a receptacle sub, wherein the locator sub and receptacle sub engage to provide an electrical connection;

a fluid source in fluid communication via a fluid flowpath with the electrical connection via the locator sub, the receptacle sub, or both; and a trigger mechanism coupled to the fluid source, wherein upon activation of the trigger mechanism a volume of flushing fluid is provided from the fluid source to the locator sub, the receptacle sub, or both, wherein the fluid source comprises:

a fluid chamber with the volume of flushing fluid; and a motive device comprising an activation chamber formed with a knocker piston movably and sealingly engaged with a housing;

wherein the fluid chamber is formed with the knocker piston movably and sealingly engaged with a housing;

wherein the motive device produces an activation force in response to a pressure differential between wellbore hydrostatic pressure and a volume of gas below atmospheric pressure, at atmospheric pressure, or above atmospheric pressure within the activation chamber; and wherein the volume of flushing fluid is pressurized by the knocker piston via the activation force.

19. The downhole tool of claim 18, wherein the locator sub comprises:

a body with a generally cylindrical shape and a flow bore;

a conductor within an electrical conduit electrically coupled to a control system;

a resilient connector electrically coupled to the conductor;

at least one seal coupled to the body; and a hydraulic port fluidically coupled to a hydraulic conduit, and wherein the receptacle sub comprises:

a housing with a generally cylindrical shape with a bore;

a conductor within an electrical conduit electrically coupled to at least one downhole tool;

a ring connector electrically coupled to the conductor; and a hydraulic port fluidically connected to a hydraulic conduit.

20. A downhole tool, comprising:

an electrical disconnect tool comprising a locator sub and a receptacle sub, wherein the locator sub and receptacle sub engage to provide an electrical connection;

a fluid source in fluid communication via a fluid flowpath with the electrical connection via the locator sub, the receptacle sub, or both; and a trigger mechanism coupled to the fluid source, wherein upon activation of the trigger mechanism a volume of flushing fluid is provided from the fluid source to the locator sub, the receptacle sub, or both, wherein the trigger mechanism comprises:

an isolation sleeve with a generally cylinder shape with an inner surface movingly and sealingly engaged with a second isolation seal and first isolation seal on a connector; and a retaining spring configured to bias the isolation sleeve into a first configuration;

wherein the first configuration retains the volume of flushing fluid within a fluid source;

wherein a second configuration releases the volume of flushing fluid from the fluid source into the fluid pathway; and wherein connection of the electrical connection via workstring manipulation displaces the isolation sleeve from the first configuration to a second configuration.

21. The downhole tool of claim 20, wherein the locator sub comprises:

a body with a generally cylindrical shape and a flow bore;

a conductor within an electrical conduit electrically coupled to a control system;

a resilient connector electrically coupled to the conductor;

at least one seal coupled to the body; and a hydraulic port fluidically coupled to a hydraulic conduit, and wherein the receptacle sub comprises:

a housing with a generally cylindrical shape with a bore;

a conductor within an electrical conduit electrically coupled to at least one downhole tool;

a ring connector electrically coupled to the conductor; and a hydraulic port fluidically connected to a hydraulic conduit.

* * * * *